United States Patent [19]

Covey

[11] Patent Number: 4,579,345

[45] Date of Patent: Apr. 1, 1986

[54] BOARD GAME

[76] Inventor: Gerald W. Covey, 201 N. Jackson St., Milledgeville, Ga. 31061

[21] Appl. No.: 573,203

[22] Filed: Jan. 23, 1984

[51] Int. Cl.[4] ..... A63F 3/00

[52] U.S. Cl. ..... 273/243

[58] Field of Search ..... 273/243, 253, 248, 242, 273/303, 236, 260, 261

[56] References Cited

U.S. PATENT DOCUMENTS

| | | | |
|---|---|---|---|
| 1,139,356 | 5/1915 | Fields | 273/243 |
| 1,323,872 | 12/1919 | Lajara | 273/248 |
| 2,549,495 | 4/1951 | Lightfoot | 273/253 |
| 3,746,344 | 7/1973 | Hodan | 273/243 |
| 3,796,432 | 3/1974 | Beakley | 273/243 |

FOREIGN PATENT DOCUMENTS

| | | | |
|---|---|---|---|
| 2502022 | 9/1982 | France | 273/243 |
| 1280161 | 7/1972 | United Kingdom | 273/243 |
| 2019228 | 10/1979 | United Kingdom | 273/253 |
| 2037591 | 7/1980 | United Kingdom | 273/243 |

OTHER PUBLICATIONS

Selchow & Righter, 100th Anniversary Game Catalog, Bayshore, N.Y., 1968, p. 23.

*Primary Examiner*—Richard C. Pinkham
*Assistant Examiner*—Benjamin Layno
*Attorney, Agent, or Firm*—V. L. Leon; Harry I. Leon

[57] ABSTRACT

Movable game tokens are placed on a game board partitioned into twelve regions known as house areas and into forty-eight other subdivisions known as zodiac squares in response to throws of a pair of dice and on the basis of actions dictated by additional chance means including three preshuffled decks of cards. Two of these decks have cards with one or more directions imprinted thereon which call for the placement on or removal of at least one game token from one of the zodiac squares. The house areas, each of which bears a different zodiac sign and is proximate four zodiac squares, are grouped in eight sets of three, each known as trigons. The house areas within each trigon are associated either with the same major planet or with the same minor planet. Each of the four trigons associated with a major planet is assigned to one of the contestants before play is commenced. A player wins by being the first to perform the process three times of removing the game tokens from all of the zodiac squares contiguous his trigon.

4 Claims, 12 Drawing Figures

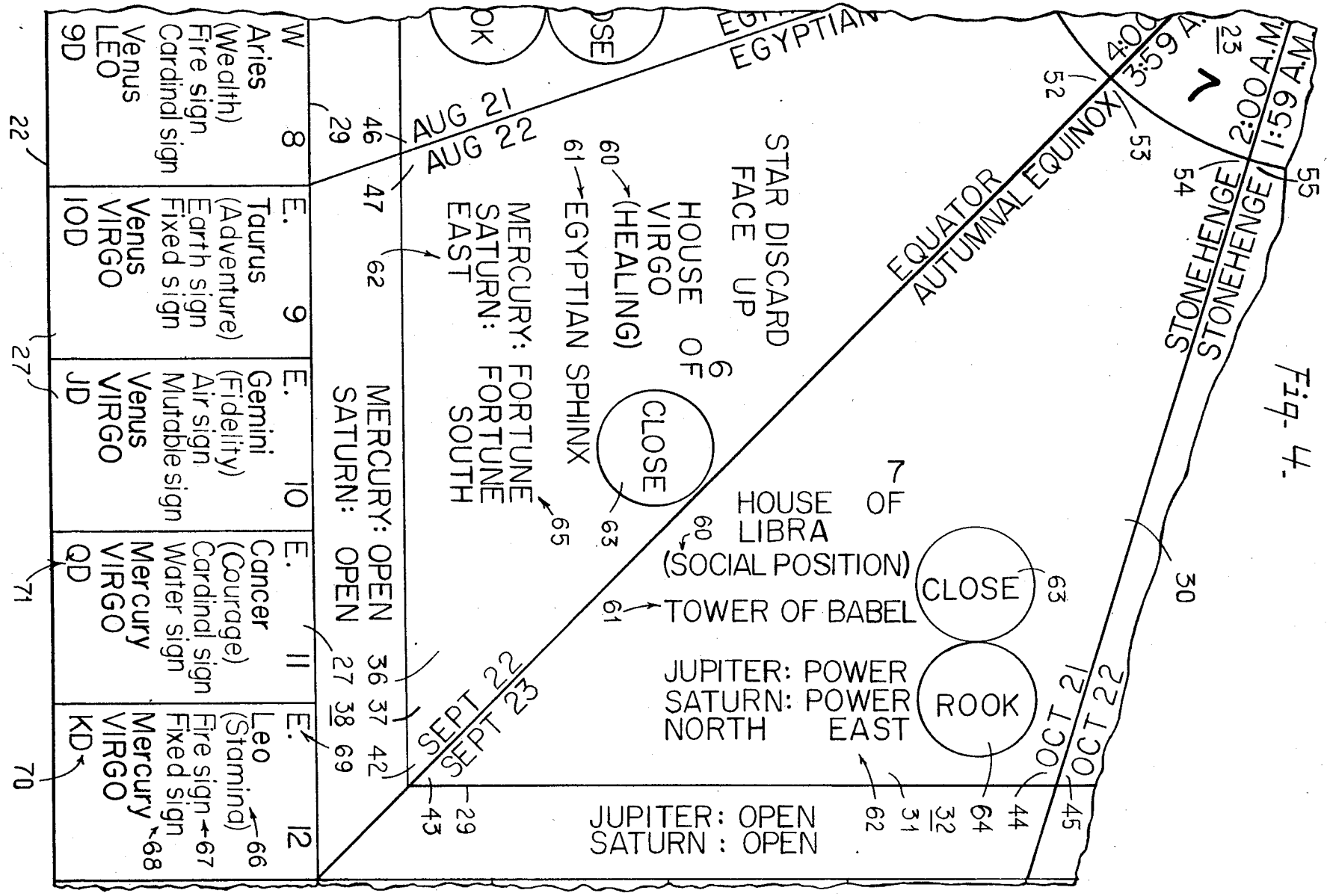
Fig. 4.
STONEHENGE
STONEHENGE
1:59 A.M.
2:00 A.M.
3:59 A.M.
4:00
23
54
55
53
52
30
OCT 21
OCT 22
45
44
64
32
31
62
63
CLOSE
ROOK
EQUATOR
AUTUMNAL EQUINOX
EGYPTIAN
7
HOUSE OF LIBRA
(SOCIAL POSITION)
TOWER OF BABEL
JUPITER: POWER
SATURN: POWER
NORTH EAST
JUPITER: OPEN
SATURN : OPEN
STAR DISCARD
FACE UP
6
HOUSE OF
VIRGO
(HEALING)
60
61
CLOSE
63
EGYPTIAN SPHINX
65
MERCURY: FORTUNE
SATURN: FORTUNE
EAST SOUTH
SEPT 22
SEPT 23
29
43
OSE
OK
AUG 21
AUG 22
46
47
62
MERCURY: OPEN
SATURN: OPEN
36 37 42
27 38 69
29
W 8
Aries
(Wealth)
Fire sign
Cardinal sign
Venus
LEO
9D
E. 9
Taurus
(Adventure)
Earth sign
Fixed sign
Venus
VIRGO
10D
E. 10
Gemini
(Fidelity)
Air sign
Mutable sign
Venus
VIRGO
JD
E. 11
Cancer
(Courage)
Cardinal sign
Water sign
Mercury
VIRGO
QD
E. 12
Leo
(Stamina)
Fire sign
Fixed sign
Mercury
VIRGO
KD
66
67
68
22
27
71
70

Fig. 9.

SOLAR ECLIPSE 5C ← 71
Single
Total solar eclipse of ← 79
East.
All Air signs of East ← 75
must open. (6)
Draw again. (CHANCE) ← 77

Fig. 10.

74 → SUN SIGNS
DATE
Double
If Sun is in 12th HOUSE
and Moon is in 1st HOUSE, 75 →
all Aries signs and
Pisces signs must open. (8)
77 → Draw again. (PLANET)

Fig. 11.

INVERSION 10S ← 71
Single
MERCURY inverts, goes 79
behind the Sun.
Last 6 squares under ← 75
MERCURY must open. (6) ← 76
Draw again. (CHANCE) ← 77

Fig. 12.

74 ZODIAC SQUARES
Double
79 MERCURY and VENUS are
aligned evening stars of
West north of Sun.
75 All squares must close
except for each player's
zodiac squares. (48)
101 Each player's Sun and
Moon squares must open.
76 (16)
77 Draw again. (PLANET)

BOARD GAME

BACKGROUND OF THE INVENTION

1. Field of the Invention

This invention relates to games and in particular to an amusing game appealable to those interested in astrology and in its historical origins.

2. Description of the Prior Art

Since ancient Babylonian times, astrologers have assumed that the relative positions of the sun, moon, planets, stars and other heavenly bodies influence human affairs. The horoscope at the time of a person's birth, or the position of the planets in relation to the zodiac at that moment, has long been regarded as determining one's destiny. The zodiac, an imaginary band of the sky extending eight degrees on each side of the ecliptic, within which the moon and principal planets remain, represents the sun's apparent annual path through the fixed stars. The zodiac is traditionally divided into twelve equal parts, or signs, each named after a different constellation, i.e., Aries, Taurus, Gemini, Cancer, Leo, Virgo, Libra, Scorpio, Sagittarius, Capricorn, Aquarius, and Pisces. To erect a horoscope for a specific date and moment of time and for a given geographical coordinate, modern-day astrologers rely on astronomical fasts which are readily available from various tables such as an ephemeris which comprises annual tables of planetary motions, a time change table, a latitude/longitude table, and a Table of Houses.

The ancient Babylonian originators of the concept of the zodiac and their Egyptian successors had to cast horoscopes from a much less detailed knowledge of the universe. Only the four planets closest to the earth, i.e., Mercury, Venus, Mars, and Jupiter, were known to these people. Although their observations of the cyclic nature of the zodiac, of the solstices and of the equinoxes as well as of the opposing positions of the solstices and of the equinoxes in the solar year had led them to the concept of an equator, there is no solid evidence that they knew about the Earth's rotation or ecliptic. Indeed, they thought that the heavens, the observed celestial sphere, passed over the surface of the Earth, with the sun moving across this sphere along a path half-way between the extremes of the summer and winter solstices. The sun for them was akin to a traveller who began his journey in any direction from some reference point on Earth and who, if he continued to travel in a straight line, would eventually reach a point exactly opposite that reference point, to which he would eventually return if he were then to travel in any direction and in a straight line from that opposite point.

Like their modern day counterparts, the early practitioners of astrology thought that each of the four then known planets in some way reflected the qualities of the zodiac sign with which it was connected, with the influence of a planet depending upon its house or apparent location relative to the Earth's horizon. The Egyptians connected Mercury, which they associated with summer, with the three zodiac signs appearing between June 21st and Sept. 22nd; Jupiter, which they associated with autumn, with the three signs between Sept. 23rd and Dec. 20th; Mars, which they associated with winter, with the three signs between Dec. 21st and Mar. 20th; and Venus, which they associated with spring, with the signs between Mar. 21st and June 20th. Attaching great significance to the site occupied by the Great Sphinx of Egypt, they viewed the heavens as being divided into four equal parts which intersected above it and held it to be closely guarded by Mercury in summer, Jupiter in autumn, Mars in winter, and Venus in spring.

The site of the Sphinx is thought to have been suggested by the Babylonians because of its relationship to a cyclic pattern which was formerly followed by Sirius, the Dog Star, and which coincided with the summer and winter solstices, thereby marking the seasons in ancient Egyptian times. In fact, the north-south position of the Sphinx was selected so that the first appearance of Sirius on the eastern horizon immediately before sunrise every year, a phenomenon signalling the beginning of the longest day of the Egyptian solar year, occurred east of the Sphinx. As the solar year progressed, Sirius grew in brightness and climbed higher into the night sky until the time of the winter solstice at which point Sirius began to grow dimmer until it completely disappeared in the night of Jan. 20 and morning of Jan. 21. Not only did the Egyptians declare everything on the left side of the Sphinx, beginning at the left mid-section thereof, to be in the north and everything on the right side of the Sphinx, beginning at the right mid-section thereof, to be in the south, they also used the Sphinx to mark the ancient Egyptian prime meridian. Everything in front of the Sphinx, including the head, was considered to be in the east and everything behind, including the body, to be in the west.

Unlike the present day system in which the sky zodiac is considered to begin with Aries and end with Pisces, the sky zodiac signs in ancient Egypt were assumed to begin with Virgo and end with Leo. Significantly, the head of the Sphinx represents the zodiac sign Virgo and its body the zodiac sign Leo, with the representation of Virgo being situated east of that of Leo. Using the Sphinx both as the physical representation of their god of the horizon, Horus, and as a physical marker to delineate the houses or zodiac boundaries on Earth, the Egyptians also declared that on Earth the zodiac signs began with Virgo at the head of the Sphinx and with Leo behind its head and progressed eastward and westward, respectively. They also viewed the zodiac signs as progressing northward from the left mid-section of the Sphinx and southward from its right mid-section, beginning with Aquarius and with Pisces, respectively. In each case, the progression of the zodiac signs followed the natural sequence of the zodiac. Under the present day system, the houses or zodiac boundaries of Earth vary with the several different versions in use, one of these being the ancient Egyptian system which has been greatly modified from the original.

Therefore, a principal object of the present invention is the provision of a board game conceptually related to the horoscopes which the ancient astrologers of Babylon and of Egypt erected based on their limited understanding of the universe, whereby students of astrology may gain an insight into the origins of their art while at the same time amusing themselves with a game of chance and skill.

SUMMARY OF THE INVENTION

The game apparatus of this invention comprises generally a game board on which are depicted a plurality of segmented regions subdivided into zodiac squares and a plurality of house areas, each of which displays the name of a different zodiac sign; two sets of game tokens of which substantially equal numbers from the first set are assigned to each of the segmented regions and positioned in relation to the zodiac squares therewithin and of which tokens in the second are assigned to the house areas; and means for selecting the positions of the game tokens of both sets.

The means for selecting the positions of the game tokens of the first set comprises three decks of playing cards and a third set of game tokens. The latter tokens are employed to exclude, from play and for the duration of a game, at least one predetermined zodiac square within each of the segmented regions. The zodiac squares so excluded bear indicia related to the zodiac signs under which the contestants were born. Two of the decks of cards have instructions displayed on one face thereof which are related to indicia on the game board and which direct the positioning of at least one game token of the first set in relation to one of the zodiac squares. These two decks also contain cards which have instructions related to drawing another card, but only one of them has cards which have legendary matter related to drawing a card from the other deck of the pair. Cards in the third deck bear neither type of instruction; but each of them displays indicia which are reproduced on only one of the zodiac squares and on only one other card in the game apparatus.

In the preferred embodiment, a fourth set of game tokens are positioned on zodiac sectors within a centrally disposed circular area of the game board at the outset of a game and re-positioned during the course thereof, if necessary. The fourth set of game tokens comprises means for registering the time of day in predetermined two hour increments and the day of the year in terms of one of twelve equal divisions of the solar year. Two of the decks include cards bearing instructions for positioning the game tokens in the first set which are contingent upon the positions of the game tokens in the fourth set.

The playing surface of the game board is preferably delineated by four sides within which house areas are displayed in successive relationship and with each segmented region positioned proximate the outermost periphery of three house areas in each of which the name of the same major planet appears. Each of the boundaries between successive pairs of house areas displaying the names of different major planets bear labels which are related to a natural phenomenon which marks the onset of a new season of the year, i.e., the solstices and the equinoxes. In the preferred embodiment, each such boundary is positioned so that its extension, through the centrally disposed circular area, across the playing surface is also a boundary between successive pairs of house areas which display the names of different major planets; and a label proximate the latter boundary is related to a natural phenomenon which occurs one-half of a solar year distant in time from the event with which it is thus paired across the game board. Also, the boundary between the house areas displaying the zodiac signs Leo and Virgo, respectively, preferably bears the phrase "EGYPTIAN SPHINX;" and a direction indicator is displayed on each of the house areas, as well as on the zodiac squares contiguous thereto, relating its position with respect to the Sphinx in accord with ancient Egyptian practice. Cards in one of the decks include instructions based on these direction indicators for positioning the game tokens in the first set.

BRIEF DESCRIPTION OF THE DRAWINGS

Further details are explained below with the help of the examples illustrated in the attached drawings in which:

FIG. 4 is an enlarged fragmentary plan view of a portion of the game board which is proximate the lower right corner thereof as illustrated in FIG. 1;

FIG. 8, FIGS. 9 and 10, and FIGS. 11 and 12 are detailed plan views of representative playing cards from one of three different decks, representively, also used in playing the game.

DESCRIPTION OF THE PREFERRED EMBODIMENT

Figure 1:
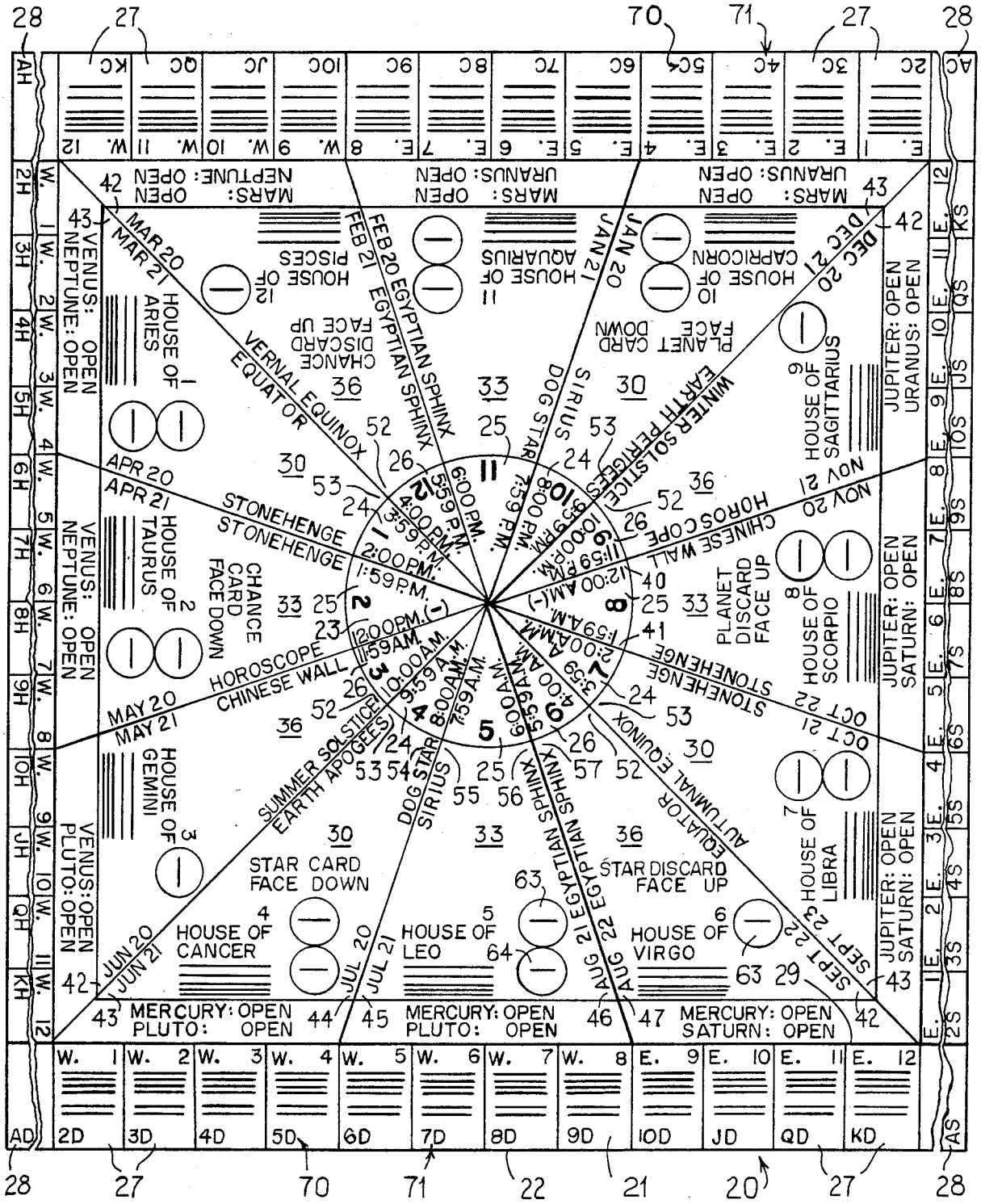
FIG. 1 is a fragmentary plan view of the game board.

In the description which follows, like parts are marked throughout the specification and drawing with the same reference numerals, respectively. The drawings are not necessarily to scale; and in some instances portions have been exaggerated in order to more clearly depict certain features of the invention.

As disclosed in the drawings, the game apparatus comprises the following components:

The game board
Game tokens
Pair of dice
Three decks of playing cards

Each of the foregoing components, together with the rules of the game, is described herein with particularity in the order named and under the appropriate headings as follows:

GAME BOARD

In the drawings, a game board 20 which may be of any convenient size or edge contour has a playing surface 21 with a generally rectangular outer boundary 22. The boundary 22 measures, by way of example, 22 inches by 22 inches. The game board is formed of glass, metal, paper, plastic, wood or the like of a composite of such materials.

The playing surface 21 includes a centrally disposed circular area 23 which is partitioned into multiple zodiac sectors 24, 25, 26; house areas 30, 33, 36; and zodiac squares 27. As is explained under the heading, "RULES OF THE GAME," each player has at least three house areas and twelve zodiac squares at his command. The circular area 23, on the other hand, is employed to depict the cyclical nature of time with each sector 24, 25, 26 representing a two hour increment in a terrestrial day and one of the twelve equal parts of a solar year. The sectors are consecutively numbered 1 through 12 in counterclockwise fashion, each sector having displayed within the confines thereof an identifying numeral and having two time cusps 40, 41 on which are denoted times of day which are one hour fifty-nine minutes apart.

The playing surface 21 is further subdivided into house areas 30, 33, 36 which are delineated within an inner boundary 29. As is best seen in FIG. 1, each house area is contiguous one of the sectors 24, 25, 26, the two sides of which, when extended radially, form the two sides of the house area. The house areas are also numbered 1 through 12 after certain fixed star constellations in the order of their natural sequence in the zodiac as follows: Aries, Taurus, Gemini, Cancer, Leo, Virgo, Libra, Scorpio, Sagittarius, Capricorn, Aquarius, and Pisces. In the preferred embodiment illustrated in FIG. 1, the house area contiguous the zodiac sector numbered 1 has been named "HOUSE OF ARIES."

On the game board 20, the house areas 30, 33, 36 are grouped in eight sets of three each. Four of these sets in which the house areas are numbered 1 through 3, 4 through 6, 7 through 9, and 10 through 12, respectively, each oppose a different side of the boundary 22. When the sides of the boundary 29 are of approximately equal length, the apex angles of the three sectors 24, 25, 26 contiguous the house areas 30, 33, 36, respectively, in each of the latter four sets total approximately 90°. Because the three zodiac signs after which the house areas in each of these sets are named constitute a trigon, one of four equal subdivisions of the zodiac, sets of three successive house areas are referred to in this specification as trigons as well. The arrangement of the trigons presented on the game board 20 depicts an important division of time: specifically, the seasons of a year.

As is best seen in FIG. 1, there is displayed proximate the boundary between successive pairs of house areas a pair of date cusps 42, 43; 44, 45; 46, 47. The cusps 42, 43 bear the approximate dates based on the present day Gregorian calendar of naturally occurring phenomena which traditionally demarcate the four seasons, i.e., the vernal equinox, the summer solstice, the autumnal equinox, and the winter solstice. Legendary matter related to each of these annual events is displayed in one of the pair of house cusps 52, 53 proximate the same boundary along which the dates of the phenomenon are presented. For example, Mar. 20th and 21st, the approximate dates of the vernal equinox, are exhibited on either side of the boundary along which is inscribed the phrase "VERNAL EQUINOX" (FIG. 1).

Each house area 30, 33, 36 is in turn partitioned into two regions 31, 32; 34, 35; 37, 38, respectively. Displayed on the outer regions 32, 35, 38 is the name of one of the major planets or of the four planets closest to Earth, i.e., Venus, Mercury, Jupiter, or Mars, and the name of one of the minor planets, i.e., Saturn, Uranus, Neptune, or Pluto. In addition, the signal word "OPEN" is presented after each of these planet names. As will be apparent as the description proceeds, this signal word indicates a space for one or more game tokens (pawns) to be placed when at least one of the four zodiac squares 27 contiguous a region 32, 35, 38 is said to be open.

Following the ancient Egyptian system described under the heading, "BACKGROUND OF THE INVENTION," Venus, associated with spring, is assigned to the house areas numbered 1, 2 and 3 on the game board 20; Mercury, associated with summer, to the house areas numbered 4, 5, and 6; Jupiter, associated with autumn, to the house areas numbered 7, 8, and 9; and Mars, associated with winter, to the house areas numbered 10, 11, and 12 (FIGS. 1–4). Each of the names of the minor planets is also assigned to three consecutive house areas, but only two of these house areas are within the confines of the boundaries delimiting a single season. As illustrated in the drawings, Saturn is assigned to the house areas numbered 6, 7, and 8; Uranus to the house areas numbered 9, 10, and 11; Neptune to the house areas numbered 12, 1, and 2; and Pluto to the house areas numbered 3, 4, and 5. This assignment of minor planets is in accordance with their standard values under the present day European Horoscope system in which Saturn was assigned to be one-third the value of Mercury and two-thirds the value of Jupiter; Uranus was assigned to be one-third the value of Jupiter and two-thirds the value of Mars; Neptune was assigned to be one-third the value of Mars and two-thirds the value of Venus; and Pluto was assigned to be one-third the value of Venus and two-thirds the value of Mercury.

Figure 2:
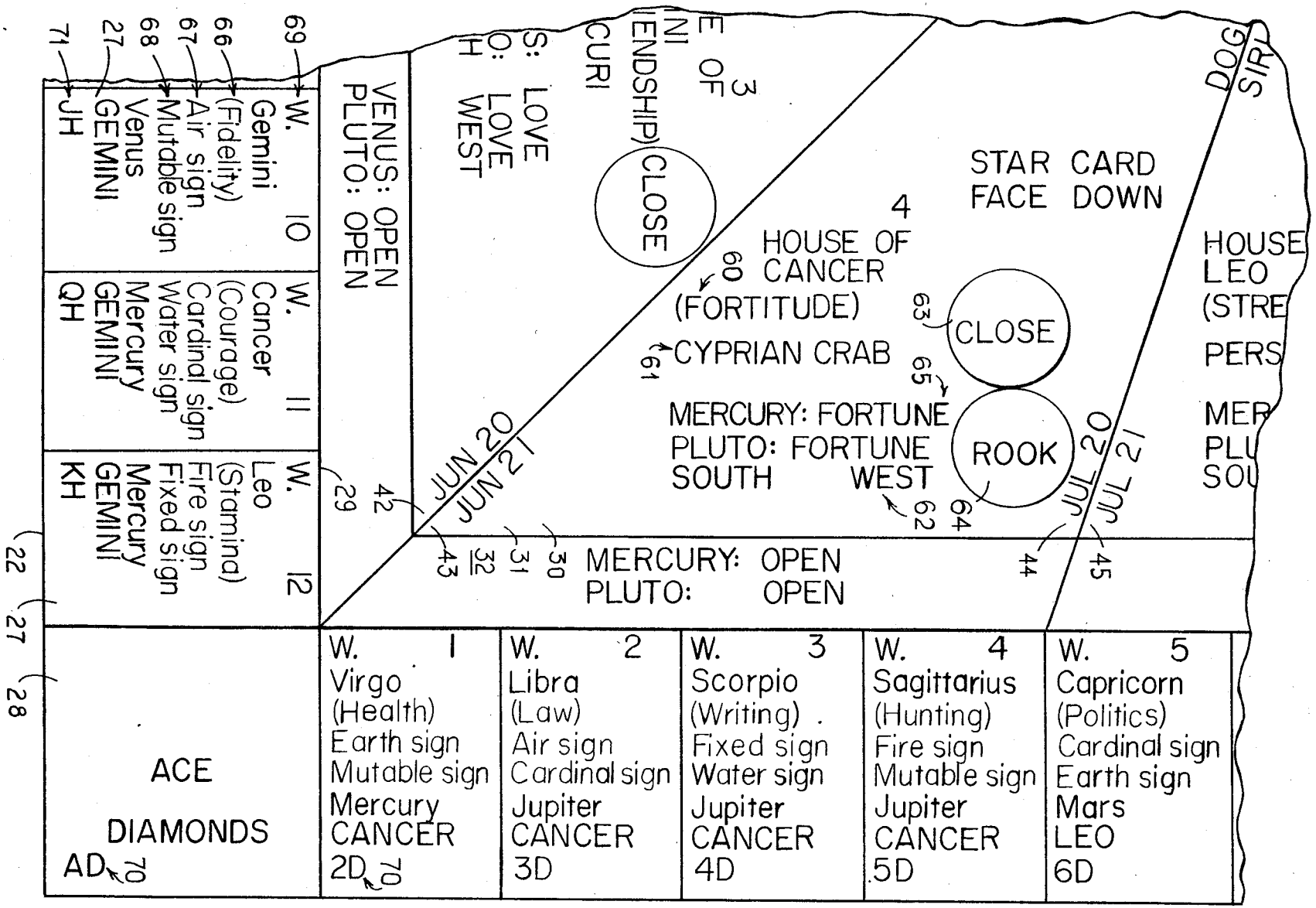
FIG. 2 is an enlarged fragmentary plan view of a portion of the game board which is proximate the lower left corner thereof as illustrated in FIG. 1.
Figure 3:
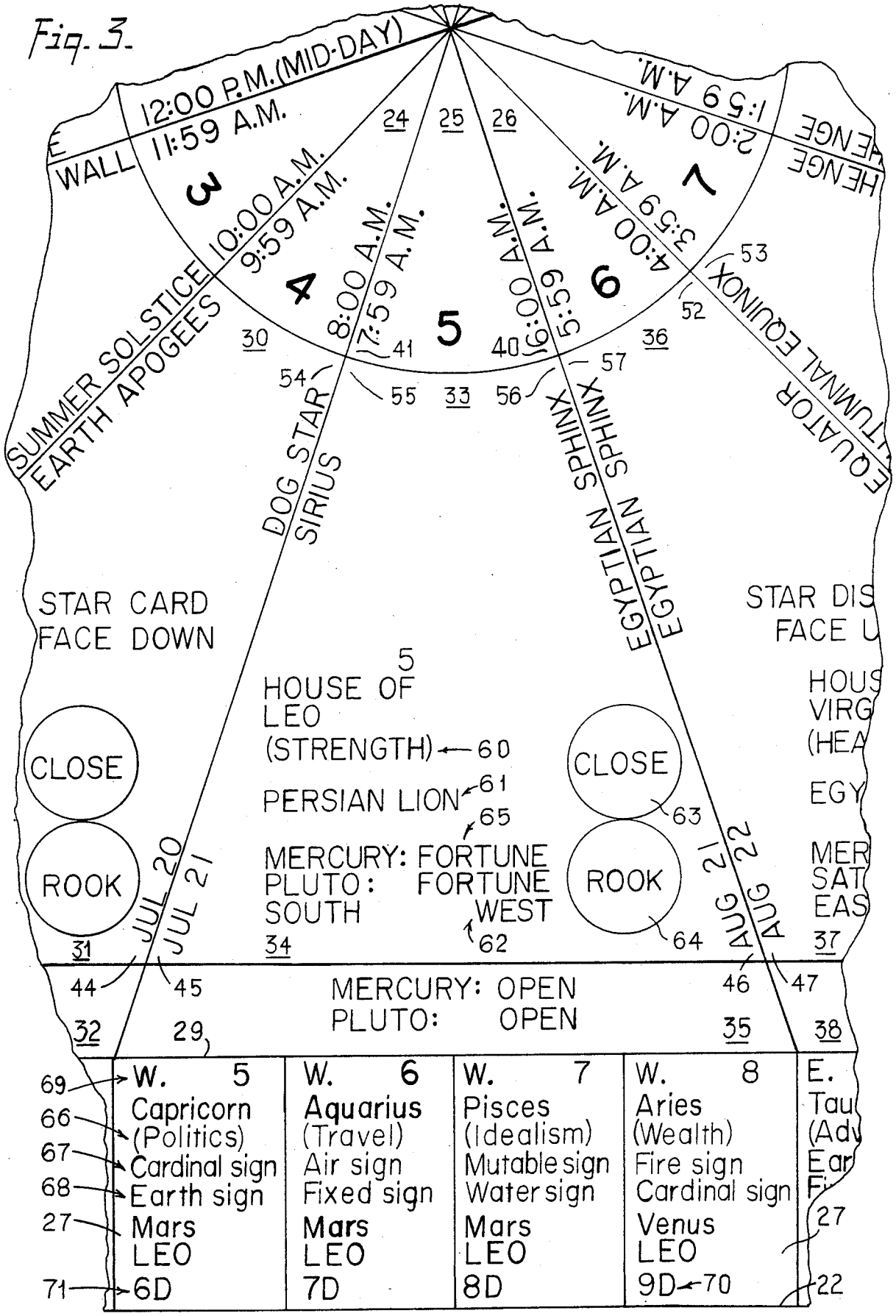
FIG. 3 is an enlarged fragmentary plan view of a portion of the game board which is proximate the center of the lower half thereof as illustrated in FIG. 1.

Further, a verbal value, indicated generally by the reference numeral 65 and based on the traditional Greco-Roman mythologies, is assigned to each of the major planets and displayed on the inner region 31, 34, 37 beside the name of the planet as follows: "VENUS: LOVE;" "MERCURY: FORTUNE;" "JUPITER: POWER;" and "MARS: FAME." The same verbal value is juxtaposed beside the name of the minor planet paired with the name of one of the major planets in a region 31, 34, 37 (FIGS. 2–4).

In addition to the date cusps 42, 43 and house cusps 52, 53 along the boundaries which demarcate the four seasons, there are date cusps 44, 45; 46, 47 and house cusps 54, 55; 56, 57 proximate either side of the boundaries between successive house areas 30, 33, 36 which display the name of the same major planet (FIGS. 1–4). These date cusps 44, 45; 46, 47 bear the dates on which a zodiac period, or one of the twelve equal parts of the solar year, is considered to end and another to begin, respectively. Suggestive of the opposing positions of the solstices and of the equinoxes, each of the phrases in the house cusps 54, 55; 56, 57 is preferably repeated within a second house cusp paired with a date cusp bearing a date one-half year distant in time from that with which the phrase is coupled elsewhere on the game board 20. Another similarity to the boundaries demarcating the four seasons is seen in the combination of the date cusps for Jan. 20th and 21st and of the house cusps with labels referring to Sirius and to the Dog Star. These dates once coincided with a natural phenomenon, the annual disappearance of Sirius, the Dog Star, from the night sky in ancient Egypt.

Other legendary matter appearing in the house cusps 54, 55 includes the phrase "STONEHENGE;" and in the house cusps 56, 57, the phrases "EGYPTIAN SPHINX," "CHINESE WALL," and "HOROSCOPE." "EGYPTIAN SPHINX" is positioned proximate the boundary between the house areas bearing the zodiac signs Leo and Virgo, respectively, which, as has been explained, were closely associated with the Sphinx in ancient Egyptian times. Stonehenge in Europe and the great Chinese Wall, like the Sphinx, were used by the respective cultures which created them to divide the land masses and the heavens; and reference to Stonehenge and to the Chinese Wall on the game board 20 is made to draw attention to this fact. Moreover, the phrases "EGYPTIAN SPHINX," "STONEHENGE," and "CHINESE WALL" have been placed between the fifth and sixth house areas, between the first and second house areas, and between the second and third house areas, respectively, during the summer half of a solar year to reflect a correspondence which may be made between the geographical locations of the Sphinx, of the Chinese Wall and of Stonehenge in terms of houses or zodiac boundaries on Earth.

In addition, the inner regions 31, 34, 37 of the house areas 30, 33, 36 have imprinted or otherwise presented within the confines thereof legendary matter including a characteristic, a mythological name, and a direction indicator, pointed out generally by the reference numerals 60, 61, 62, respectively, as follows:

| House Name | Characteristic | Mythological Name | Direction Indicator |
|---|---|---|---|
| Virgo | Healing | Egyptian Sphinx | East South |
| Libra | Social Position | Tower of Babel | North East |
| Scorpio | Philosophy | Asian Scorpion | North East |
| Sagittarius | Searching | Grecian Centaur | North East |
| Capricorn | Arbitration | Chinese Dragon | North East |
| Aquarius | Inventiveness | Arabian Firebird | North East |
| Pisces | Spiritualism | Sea of Galilee | West North |
| Aries | Psychics | Golden Fleece | South West |
| Taurus | Odysseys | Cretan Bull | South West |
| Gemini | Friendship | Dioscuri | South West |
| Cancer | Fortitude | Cyrian Crab | South West |
| Leo | Strength | Persian Lion | South West |

The north-south ordinate of each direction indicator is dependent upon the position of the house area relative to the boundary marked "EQUATOR" (FIG. 4). Those house areas having an ordinate "SOUTH" may be viewed as representing positions south of the sun in accord with the ancient Egyptian belief that the path of the sun and the Earth's equator paralleled each other.

Within the confines of the inner regions 31, 34, 37 of the house areas 30, 33, 36 are also differentiated circular areas 63, 64 which present the signal words "CLOSE" and "ROOK," respectively. Under the rules of the game which are explained more fully hereinafter, each player must place a game token (a rook 83) on the area 64 before commencing his turn. As will be apparent as the description proceeds, the placement of another game token (a bishop 81) on an area 63 by a player signals that he has successfully opened all the zodiac squares 27 under his control and thereafter has thrown, within three attempts, a double number with a pair of dice, a process which he must then repeat two more times to win the game.

Additional legendary matter displayed on the house areas numbered 2, 4, 6, 8, 10, and 12 of the preferred embodiment shown in FIG. 1 includes the phrases "CHANCE CARD FACE DOWN," "STAR CARD FACE DOWN," "STAR DISCARD FACE UP," "PLANET DISCARD FACE UP," "PLANET CARD FACE DOWN," and "CHANCE DISCARD FACE UP," respectively. The significance of the STAR, PLANET, and CHANCE cards is set forth below.

As illustrated in FIG. 1, a segmented region having zodiac squares 27 numbered 1 through 12 is disposed between the boundaries 22 and 29 along each of the four sides of the playing surface 21. These twelve zodiac squares abut a segment of the boundary 29 which is subtended by a set of three sectors 24, 25, 26, so that there are four zodiac squares 27 proximate each house area 30, 33, 36. The zodiac squares are each named after the same fixed star constellations as the house areas, but the names on the squares begin and end as the zodiac signs did in the ancient Assyro-Babylonian and Egyptian system, as follows: Virgo, Libra, Scorpio, Sagittarius, Capricorn, Aquarius, Pisces, Aries, Taurus, Gemini, Cancer, and Leo, with each of the four zodiac squares numbered 1 being assigned the zodiac name or sign "Virgo."

As shown in FIGS. 1–4, there are also presented on each zodiac square 27 a direction indicator, a characteristic, and a pair of horoscope signs, which are indicated generally by the reference numerals 69, 66, and 67, 68, respectively. The direction indicator 69 of each zodiac square is dependent upon the position of the house area continguous thereto relative to the boundary marked "EGYPTIAN SPHINX" (FIG. 1). Those zodiac squares 27 labeled "E." may be viewed as representing positions east of the Sphinx in accord with the ancient Egyptian system. Not only do each of the four zodiac squares 27 on the game board 20 which are assigned the same number also have the same zodiac name or sign; but each of these four squares displays the same characteristic 66, the same pair of horoscope signs 67, 68, and the name of the major planet which is associated with the house area having the same sign as that of the zodiac square itself. In addition, the sign of the house area with which a particular square is contiguous is duplicated on that square.

Besides the twelve zodiac squares 27 positioned along each of the four sides of the playing surface 21, there are four corner squares 28 (FIGS. 1 and 2). Indicia, indicated generally by the reference numeral 70, and corresponding to the suit of a CHANCE card are displayed on one of the corner squares 28 and on the twelve successive zodiac squares 27 which share a common side of the boundary 22 with the corner square 28. In the preferred embodiment shown in FIGS. 1–4, the twelve zodiac squares 27 contiguous the house areas numbered 1 through 3 have been assigned the symbols "2H" through "10H", "JH," "QH" and "KH" in succession. The corner square 28 grouped with these twelve zodiac squares is labeled "ACE HEARTS" and bears the symbol "AH." Similarly, the remaining three corner squares 28 and the twelve zodiac squares 27 extending to the right of each of them are identified with other CHANCE card suits: specifically, with the suits of diamonds, spades, and clubs.

GAME TOKENS

Figure 5:
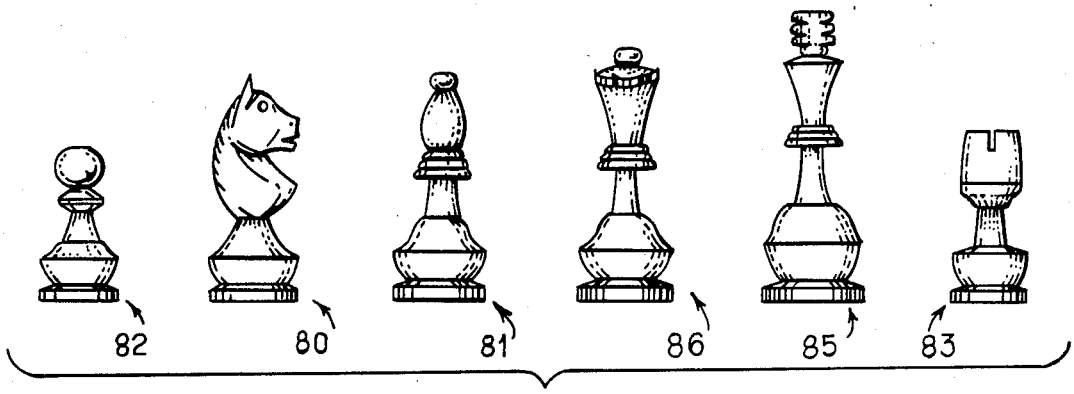
FIG. 5 is an elevation view of representative game tokens according to one embodiment of the invention used in playing the game.

Positioned upon the zodiac sectors 24, 25, 26 at the outset of a game and throughout its course is a set of playing pieces including two pairs of game tokens such as a king 85 and a queen 86 (FIG. 5). These two pairs are each of a different color. The zodiac sectors 27, together with one of these king and queen pairs, comprise means for registering a day of the year in terms of its being within one of the twelve zodiac periods of a solar year; and the zodiac sectors, together with the other king and queen pair, comprise means for registering the time of day in terms of its being within one of twelve predetermined increments of a terrestrial day. The numbers of the zodiac sectors occupied by the kings and by the queens are known as the sun and moon signs, respectively. These numbers are determined using the DATE CHART and the TIME CHART as is explained more fully hereinafter under the heading, "RULES OF THE GAME."

The positions of the first king and queen pair are not altered during the course of a game unless the day upon which it is being played changes and the first day of play occurs on the last of the calendar dates displayed on one of the house areas 30, 33, 36. The selection of the pair of sun and moon signs assigned to each of the twelve zodiac periods is based on the ancient Egyptian concept of an equator and a pattern of symmetry which the Egyptians saw involving the equator, the sun and the moon. The positions of the second king and queen pair are not altered as long as the time of day at which the game is being played continues to fall within the same one hour fifty-nine minute increment displayed on one of the zodiac sectors 24, 25, 26 as the time of day at which the game began. The selection of the pair of sun and moon signs assigned to each predetermined increment of a day is based on the ancient Babylonian system. Under the rules of the game, an one-to-one correspondence is made between the sun and moon signs and the numbers on the zodiac squares 27 contiguous each trigon of house areas 30, 33, 36; this correspondence not only affects the course of a game but makes it dependent upon the time of day and the day of the year play is in progress.

Prior to commencing play, each player identifies himself with at least one of the major or minor planets. With each planet which he selects, a player is assigned a trigon of house areas 30, 33, 36, each of which has the name of that planet displayed thereon and the twelve zodiac squares 27 adjoining the trigon. For each planet chosen, the player is then equipped with two sets of game tokens including a single playing piece and a set with no more than eleven playing pieces. The tokens within these two sets remain within the boundaries of the assigned trigon and the twelve squares contiguous thereto. Suitable game tokens for these sets include a knight 80 and pawns 82 (FIG. 5).

So equipped, each player determines, using the calendar dates presented in the date cusps 42, 43; 44, 45; 46, 47, which one of the twelve zodiac squares 27 that are contiguous his trigon displays the zodiac sign under which he was born and places his knight on that square where it remains throughout the course of a game. Subsequently, he places a pawn 82 upon each of the zodiac squares 27 which bound his trigon and which are not occupied by his knight or the knight or pawn of another player. In this manner, at least one of the twelve zodiac squares within each of the four segmented regions along the boundary 22 is reserved from those zodiac squares in relation to which the pawns are positioned.

In addition to the pawns 82, other playing pieces are also utilized to indicate the progress of a game. In the preferred embodiment, they include a twelve piece set of bishops 81 and a single piece in the form of a rock 83 (FIG. 5). Prior to beginning his turn, each contestant must position the rock on the circular area 64 marked "ROOK" which is within the house area 30, 33 having the middle number in his trigon. Otherwise, the player forfeits his turn.

In connection with the twelve piece set of bishops 81, it will here be stated that the object, intent, and purpose of the game is for a player to be the first to place three of these playing pieces on the circular areas 63 marked "CLOSE" within the house areas 30, 33, 36 of the trigon under his control and in such a manner that one of these pieces is placed on the circular area 63 of the house area on the immediate left of his trigon first and on the circular area of the house area on the immediate right of his trigon last. A player places a bishop 81 when he was succeeded, within three attempts, at throwing a double number with a pair of dice 88 after having earned or received a directive to throw them. Such a directive, as is hereinafter more fully explained under the heading, "RULES OF THE GAME," issues when the players, as a result of following instructions applicable to the various game tokens under their control, find that all of the pawns 82 have been removed from the zodiac squares contiguous the house areas 30, 33, 36 of a trigon which an individual player controls.

Figure 6:
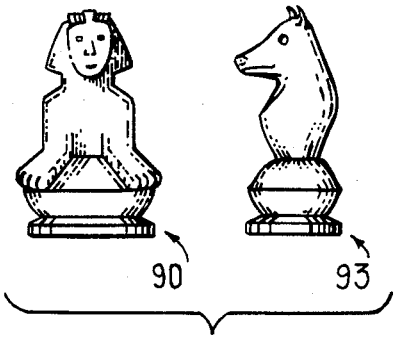
FIG. 6 is an elevation view of representative game tokens according to an alternate embodiment of the invention.

Thus the game apparatus includes the following game tokens: one sun sign token for the date and one for the time of day; one moon sign token for the date and one for the time of day; eight zodiac sign tokens; forty-four zodiac square tokens, twelve zodiac house closer tokens; and one turn-piece token. In the preferred embodiment described immediately above, these tokens are embodied in traditional chessmen of Indo-European origin including two kings 85, two queens 86, eight knights 80, forty-four pawns 82, twelve bishops 81, and one rock 83, respectively (FIG. 5). They measure, by way of example, from 1½ inches to 3 inches in height and may be formed of wood, bone, metal, plastic, glass, or the like. Alternatively, these pieces may be embodied, respectively, in two falcons which are symbols of the Egyptian sun god Ra; two lotus blossoms, symbols of the Egyptian moon god Sin; eight great sphinxes 90, Egyptian symbols of the zodiac and of the god of the horizon Horus; forty-four jackals, the Egyptian symbols of good fortune; twelve obelisks, Egyptian phallic symbols of Earth and divine providence; and one dog 93, the symbol of Sirius, the Dog Star, that brought the new year and marked the seasons of ancient Egypt (FIG. 6). Reminiscent of the Great Sphinx of Egypt, the sphinxes 90, representing the zodiac sign tokens in this alternate embodiment, are never moved once they are positioned at the outset of a game.

PAIR OF DICE

Figure 7:
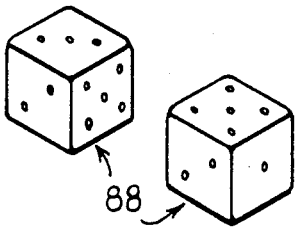
FIG. 7 is a perspective view of the dice also employed in playing the game.

The dice consist of a pair of conventional die 88 as shown in FIG. 7. The dice are used to determine the order to play. To start the game, each player in turn throws the dice. The player throwing the highest total is the first to play; the one with the next highest is second; and so on. Alternately, the player throwing the highest number is the first player; and the other players follow around the game board in a counterclockwise manner. The dice are also used at any time a player finds no pawns are situated on any of the twelve zodiac squares 27 adjoining the house areas 30, 33, 36 of his trigon as a result of one or more moves of the pawns which he or other players have made in accordance with the rules of the game. At such a juncture, the players must attempt to throw a double number with the dice within three trys. If he is successful, he then places a bishop 81 on one of the circular areas 63 within his trigon as indicated immediately above.

DECKS OF PLAYING CARDS

In the preferred embodiment, the game apparatus comprises a total of one hundred ninety playing cards of which there are fifty-two CHANCE cards, eighty-six STAR cards, and fifty-two PLANET cards. Each of these cards is preferably formed of a semi-rigid material such as paper, plastic, or the like or of a composite of such materials and measures, by way of example, 2½ inches by 3½ inches, the dimensions of standard size playing cards.

Figure 8:
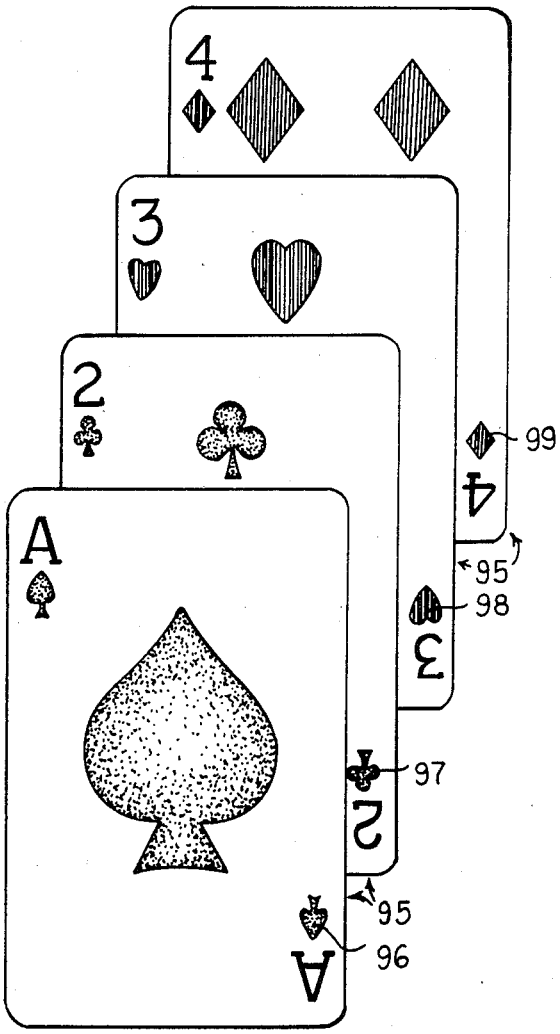

The fifty-two CHANCE cards, indicated generally by the reference numeral 95, comprise a deck of conventional playing cards having four suits of thirteen cards each, with the names of the suits being spades, clubs, hearts, and diamonds; indicia for each of these suits are indicated generally by the reference numerals 96, 97, 98, 99, respectively (FIG. 8). Each card has indicia representing one suit that is combined with one alphanumeric symbol selected from the following: A, 2–9, J, Q, and K, thereby making fifty-two different combinations in all, with each combination being displayed without duplication within the deck. Forty-eight of these fifty-two combinations are also displayed, in an equivalent form and without duplication, on either a STAR card or a PLANET card, with twenty-three of the STAR cards and twenty-five of the PLANET cards being so distinguished, as is described more fully hereinafter. The same forty-eight combinations as composite symbols, indicated generally by the reference numeral 71, are also presented, without repetition, on the forty-eight zodiac squares 27 of the game board (FIGS. 1–4). When a CHANCE card is drawn and the zodiac square having a composite symbol equivalent to the suit indicia and alphanumeric symbol of the CHANCE card is occupied by a pawn, that pawn must be removed.

In the event a CHANCE card is drawn which bears a suit indicia and alphanumeric symbol equivalent to the same composite symbol 71 as that assigned to a zodiac square 27 which displays the zodiac sign under which a player was born, that player, regardless of whether his turn is in progress, must remove all the pawns from the zodiac squares contiguous the house areas of his trigon. Likewise, if there is a composite symbol 71 present on either the last played STAR card or PLANET card which is equivalent to the suit indicia and alphanumeric symbol on a newly drawn CHANCE card, the player whose zodiac squares have indicia, indicated generally by the reference numeral 70, of the same suit must remove all of the pawns from them. Also, when the ace, or the card having the alphanumeric symbol "A," of a CHANCE card suit is drawn, the player whose zodiac squares have indicia 70 of the same unit must remove all of the pawns from the squares adjacent his trigon. In a game in which there are more than four players, a situation may arise in which more than one player is entitled to remove the pawns from the squares contiguous his trigon because of a draw of a CHANCE card; the resolution of such a tie is achieved by a throw of the dice.

Under the rules of the game, a CHANCE card is never drawn unless a STAR or PLANET card so directs. Moreover, a STAR card is always the first to be drawn during each player's turn. Portions of the STAR card deck and of the PLANET card deck, both of which are maintained separately as is the deck of CHANCE cards, call for a player to draw again from the STAR, PLANET, or CHANCE card deck and from the PLANET or CHANCE card desk, respectively. In contrast, none of the CHANCE cards exhibits such directions to draw an additional card.

Of the eighty-six STAR cards, twenty-three of them, indicated generally by the reference numeral 72, display the composite symbol 71 equivalent to the suit indicia and alphanumeric symbol of a CHANCE card (FIG. 9); and sixty-three STAR cards, indicated generally by the reference numeral 73, lack such a composite symbol (FIG. 10). Each card 72 carries an instruction thereon which directs a player to draw a CHANCE card. Of the sixty-three cards 73, on the other hand, twenty-one have instructions to draw another STAR card and thirty-seven to draw a PLANET card while the remaining five cards 73 lack instructions to draw either a STAR, PLANET, or CHANCE card, as is indicated in Chart No. 1.

Similarly, of the fifty-two PLANET cards, twenty-five of them, indicated generally by the reference numeral 100, display the composite symbol 71 equivalent to the suit indicia and alphanumeric symbol of a CHANCE card; and twenty-seven PLANET cards, indicated generally by the reference numeral 101, lack such a composite symbol (FIGS. 11 and 12). Of the twenty-seven cards, two have instructions to draw another PLANET card and four to draw a CHANCE card while the remaining twenty-one lack instructions to draw either a PLANET or a CHANCE card, as is shown in Chart No. 2.

While the draw of a CHANCE card may result in the removal of one or of all of an individual player's pawns from the game board, each draw of a STAR card or of a PLANET card presents instructions which must be followed by all of the players, whenever possible, and which include the removal of at least one pawn 82 from, or its replacement on, a zodiac square 27 specified in the directions which are imprinted or otherwise presented on each such card. Thus the STAR, PLANET and CHANCE card decks comprise means for selecting the positions of the pawns relative to the zodiac squares.

As is illustrated in FIGS. 9 and 10, a STAR card 72, 73 includes a title and at lest one statement, which are indicated generally by the reference numerals 74, 75, respectively. The statement 75 specifies which zodiac squares, if any, are to be opened and which squares, if any, are to be closed. Such an opening or closing is achieved by removing any pawn 82 present on a zodiac square cited on a card 72, 73 or by positioning a pawn on each such square on which there is no game token present, respectively. Further, on the STAR cards 72, 73 having only one statement 75, the word "Single" is juxtaposed beneath the title 74; those STAR cards with two statements 75 have the word "Double" similarly positioned. An indicator number, which is denoted generally by the reference numeral 76, may be presented in parentheses following each such statement 75 to advise the players as to the approximate number of zodiac squares 27 which are affected by the statement 75.

Each STAR card may also have displayed thereon a phrase, which is indicated generally by the reference numeral 79, describing a naturally occurring phenomenon (FIG. 9). The phrases 79 on the STAR cards refer to stellar events which can be seen with the naked eye at various times and which involve the moon, the sun, Halley's comet, or Sirius, the Dog Star.

Each of the STAR cards may be classified in one of fifteen categories according to the positions of the zodiac squares to be opened or to be closed as directed by a statement 75 presented on the card. These fifteen categories, each of which is accompanied by the reference number used to designate it in Chart No. 1, are as follows:

Star Card Categories

| Ref. No. | Description |
|---|---|
| 1 | Twelve zodiac squares contiguous three house areas within a particular trigon displaying the name of a |

-continued

Star Card Categories

| Ref. No. | Description |
|---|---|
| | single major planet must be opened. |
| 2 | Any two zodiac squares contiguous three house areas within a particular trigon displaying the name of a single major planet must be opened. |
| 3 | Four zodiac squares contiguous a particular house area must be opened. |
| 4 | Four zodiac squares contiguous a particular house area, with the exception of any zodiac square displaying the same number as one or more of the sun (or, alternately, of the moon) signs, must be opened. |
| 5 | Four zodiac squares contiguous a particular house area named after one of the zodiac signs must be opened; and all of the zodiac squares named after a second zodiac sign must be opened. |
| 6 | Four zodiac squares contiguous a particular house area named after one of the zodiac signs must be opened; and all of the zodiac squares named after a second zodiac sign (alternately, except the square contiguous a trigon displaying the name of a specified major planet) must be closed. |
| 7 | The first four zodiac squares contiguous a trigon of a particular major planet must be opened; and three zodiac squares, each of which adjoins a different trigon of another major planet and has the same sign as the lowest numbered house area therein, must be closed. |
| 8 | All zodiac squares named after a particular zodiac sign and having a specified direction indicator must be opened. |
| 9 | All zodiac squares named after a particular zodiac sign, with the exception of any zodiac square displaying the same number as one or more of the sun (or, alternately, of one or more of the moon) signs, must be opened. |
| 10 | All zodiac squares named after a particular zodiac sign and contiguous either of two trigons, each of which displays the name of one of two specified major planets, with the exception of any zodiac square assigned the same number as one or more of the sun (or, alternately, of one or more of the moon) signs, must be opened |
| 11 | All zodiac squares which are named after one or the other of three specified zodiac signs, provided both of the sun signs are the same number as that assigned to the house area displaying one of the three specified zodiac signs and provided one of the moon signs is the same number as that assigned to the house area displaying another of the three specified zodiac signs and the other moon sign is the same number as that assigned to the house area displaying the remaining zodiac sign, must be opened. |
| 12 | All zodiac squares named after a particular zodiac sign, except such a square contiguous a trigon of a major planet having a house area named after that particular sign, must be closed; and all zodiac squares named after two other zodiac signs which, together with the first specified sign, are separated from each other by three signs in the natural sequence of the zodiac must be closed. |
| 13 | All zodiac squares displaying a particular horoscope sign must be opened. |
| 14 | All zodiac squares displaying a particular horoscope sign and having a specified direction indicator must be opened. |
| 15 | All zodiac squares displaying a particular horoscope sign and contiguous a trigon of house areas displaying the name of a particular major planet, with the exception of any zodiac square having the same number as one or more of the sun signs (or, alternately, of one or more of the moon signs), must be closed. |

Imprinted or otherwise presented on each of the PLANET cards, designated generally by the reference numerals, 100, 101, is at least one statement 75 and title 74. The word "Single" is juxtaposed beneath the title 74 when there is only one statement 75 on a PLANET card; those cards with two and with three statements 75 have the word "Double" and "Triple," respectively, similarly positioned. Each PLANET card may also have displayed thereon an indicator number 76, a phrase 79 describing a naturally occurring phenomenon, and a command, which is indicated generally by the reference numeral 77, to draw an additional card either from the PLANET card desk or from the CHANCE card deck. The phrases 79 on the PLANET cards refer to natural occurrences involving planetary movements and the position of the four planet closest to Earth with respect to the sun, which can be observed with the naked eye at various times in nature.

The fifty-two PLANET cards 100, 101 may be grouped in thirty-five categories according to the positions of the zodiac squares to be opened or to be closed; and the legendary matter on each of the cards 100, 101 may be classified according to Chart No. 2. These categories, each of which is accompanied by the reference numeral used to designate it in Chart No. 2, are as follows:

Planet Card Categories

| Ref. No. | Description |
|---|---|
| 1. | Twelve zodiac squares contiguous a trigon displaying the name of a particular major planet must be opened. |
| 2 | Twelve zodiac squares contiguous a trigon displaying the name of a particular major planet must be opened; all other zodiac squares must be closed. |
| 3 | Any zodiac square displaying the same number as one or more of the sun signs or of the moon signs must be opened; and all other zodiac squares must be closed. |
| 4 | The first six zodiac squares contiguous a trigon displaying the name of a particular major planet must be opened. |
| 5 | The first six zodiac squares contiguous two trigons, each of which displays the name of a different specified major planet, must be opened. |
| 6 | The last six zodiac squares contiguous a trigon displaying the name of a particular major planet must be opened. |
| 7 | The last eight zodiac squares contiguous a trigon displaying the name of a particular major planet must be opened. |
| 8 | Four zodiac squares contiguous a house area displaying the name of a particular major planet must be opened; and the last four zodiac squares contiguous a trigon displaying the name of a second specified major planet must be opened. |
| 9 | Three zodiac squares displaying the name of a particular major planet and contiguous a trigon displaying the same name must be opened. |
| 10 | Three zodiac squares displaying the name of a particular major planet and contiguous a trigon displaying the name of a second specified major planet must be opened. |
| 11 | Two zodiac squares displaying the name of a particular major planet and contiguous a trigon displaying the same name must be opened; and three zodiac squares displaying the same name and contiguous a trigon displaying the name of a second specified major planet must be opened. |
| 12 | Three zodiac squares displaying the name of a first specified major planet and contiguous a trigon displaying the same name must be closed; and three zodiac squares displaying the name of a second specified major planet and contiguous a trigon displaying the name of the first specified major planet must be closed. |
| 13 | Three zodiac squares displaying the name of a first specified major planet and contiguous a trigon displaying the name of a second specified major planet must be closed; and three squares displaying the name of the second specified major planet and contiguous a trigon displaying the name of the first specified major planet must be closed. |
| 14 | Three zodiac squares displaying the name of a first specified major planet and three zodiac squares displaying the name of a second specified major planet, with all six of these zodiac squares being contiguous a trigon displaying the name of a third specified |

-continued

Planet Card Categories

| Ref. No. | Description |
|---|---|
| | major planet, must be opened. |
| 15 | Three zodiac squares displaying the name of a first specified major planet and three zodiac squares displaying the name of a second specified major planet, with all six of these zodiac squares being contiguous a trigon displaying the name of a third specified major planet, must be closed. |
| 16 | Three zodiac squares displaying the name of a first specified major planet and contiguous a trigon displaying the name of a second specified major planet must be opened; and three zodiac squares displaying the name of a third specified major planet and contiguous a trigon displaying the name of the third specified major planet must be closed. |
| 17 | Three zodiac squares displaying the name of a first specified major planet and contiguous a trigon displaying the same name must be opened; and two sets of three zodiac squares displaying the name of a second specified major planet, with one of these sets being contiguous a trigon displaying the name of the second specified major planet and the other set being contiguous a trigon displaying the name of a third specified major planet, must be opened. |
| 18 | Two sets of three zodiac squares contiguous a trigon displaying the name of a first specified major planet, wherein the squares in one of these sets display the same name and in the other set the name of a second specified major planet, must be opened; and two zodiac squares displaying the name of the second specified major planet and contiguous a trigon displaying the name of a third major planet must be opened. |
| 19 | Three zodiac squares displaying the name of a first specified major planet and contiguous a trigon displaying the same name must be opened (or, alternately closed); two sets of three zodiac squares displaying the name of a second specified major planet, wherein the squares in one of these sets are contiguous a trigon displaying the name of the second specified major planet and in the other set the name of a third specified major planet, must be closed; and three zodiac squares displaying the name of the third specified major planet and contiguous a trigon displaying the name of the second specified major planet must be opened. |
| 20 | Three zodiac squares displaying the name of a first specified major planet and contiguous a trigon displaying the same name must be closed; three zodiac squares displaying the name of the first specified major planet and contiguous a trigon displaying the name of a second specified major planet must be opened; and one zodiac square displaying the name of a third major planet and contiguous a trigon displaying the name of a fourth major planet must be opened. |
| 21 | Two sets of three zodiac squares which are contiguous a trigon displaying the name of a first specified major planet, wherein one set of squares displays the name of a second specified major planet and the other the name of a third specified major planet, must be closed; and two zodiac squares displaying the name of the third major planet and contiguous a trigon displaying the name of the third major planet must be closed. |
| 22 | Three zodiac squares displaying the name of a first specified major planet and contiguous a trigon displaying the name of a second specified major planet must be opened; three zodiac squares displaying the name of a third major planet and contiguous a trigon displaying the name of the first specified major planet must be opened; and three zodiac squares displaying the name of a fourth major planet and contiguous a trigon displaying the name of the first major planet must be closed. |
| 23 | Three zodiac squares displaying the name of a first specified major planet and contiguous a trigon displaying the name of a second specified major planet must be opened; three zodiac squares displaying the name of a third specified major planet, wherein two of these three squares are contiguous a trigon displaying the name of a fourth major planet and the remaining square is contiguous a trigon displaying the name of the third specified major planet, must be opened. |
| 24 | Three zodiac squares contiguous a trigon displaying the name of a first major planet, wherein two of the three zodiac squares display the name of a second specified major planet and the remaining zodiac square displays the name of a third specified major planet, and three zodiac squares displaying the name of a fourth specified major planet, wherein two of the three squares are contiguous a trigon displaying the name of the second specified major planet and the remaining square is contiguous a trigon displaying the name of the fourth specified major planet, must be opened. |
| 25 | Five zodiac squares contiguous a trigon displaying the name of a first specified major planet, wherein three of the five squares display the name of a second specified major planet and the remaining two squares display the name of a third specified major planet, must be opened; three zodiac squares displaying the name of the first specified major planet and contiguous a trigon displaying the name of the third specified major planet must be closed; and three zodiac squares displaying the name of a fourth specified major planet and contiguous a trigon displaying the name of the first specified major planet must be closed. |
| 26 | Four zodiac squares contiguous a trigon displaying the name of a first specified major planet, wherein three of these four squares display the name of a second specified major planet and the remaining one square displays the name of a third specified major planet, must be opened; and six zodiac squares displaying the name of a fourth specified major planet, wherein three of the six squares are contiguous a trigon displaying the name of the first major planet and the remaining three squares are contiguous a trigon displaying the name of the third major planet, must be closed. |
| 27 | Seven zodiac squares contiguous a trigon displaying the name of a first specified major planet, wherein one of these seven squares displays the same name, three more of the squares display the name of a second specified major planet, and the remaining three squares display the name of a third specified major planet, must be closed; and three zodiac squares displaying the name of the third specified major planet and contiguous a trigon displaying the name of a fourth major planet must be closed. |
| 28 | Six zodiac squares displaying the name of a first specified major planet, wherein three of these six squares are contiguous a trigon displaying the name of a second specified major planet and the remaining three squares are contiguous a trigon displaying the name of a third specified major planet, must be opened; and any two zodiac squares contiguous either the highest or the lowest numbered house area within a trigon displaying the name of the first major planet (or, alternately, any two zodiac squares contiguous either of the two lowest numbered house areas within a trigon displaying the name of a fourth major planet) must be opened. |
| 29 | Three zodiac squares displaying the name of a first specified major planet and contiguous a trigon displaying the same name must be opened; and one zodiac square displaying the name of a second specified major planet and contiguous a trigon displaying the name of the second specified major planet must be opened. |
| 30 | Three zodiac squares displaying the name of a first specified major planet and contiguous a trigon displaying the name of a second specified major planet must be opened; and one zodiac square displaying the name of a third specified major planet and contiguous a trigon displaying the name of a fourth specified |

-continued

Planet Card Categories

| Ref. No. | Description |
|---|---|
| | major planet must be opened. |
| 31 | Four zodiac squares displaying the name of a first specified major planet, wherein two of these four squares are contiguous a trigon displaying the name of a second specified major planet and the remaining two squares are contiguous a trigon displaying the name of a third specified major planet, must be closed; and two zodiac squares displaying the name of the second specified major planet, wherein one of these two squares is contiguous a trigon displaying the name of the second specified major planet and the remaining one square is contiguous a trigon displaying the name of the third specified major planet, must be closed. |
| 32 | Four zodiac squares displaying the name of a first specified major planet, wherein two of the four zodiac squares are contiguous a trigon displaying the same name and the remaining two squares are contiguous a trigon displaying the name of a second major planet, must be closed; and two zodiac squares displaying the name of a third specified major planet, wherein one of the two squares is contiguous a trigon displaying the name of the first specified major planet and the other contiguous a trigon displaying the name of the second specified major planet, must be closed. |
| 33 | Four zodiac squares displaying the name of a first specified major planet, wherein two of the four squares are contiguous a trigon displaying the name of a second specified major planet and the remaining two squares are contiguous a trigon displaying the name of a third specified major planet, must be opened; two zodiac squares displaying the name of the third specified major planet, wherein one of the two squares is contiguous a trigon displaying the name of the second specified major planet and the remaining square is contiguous a trigon displaying the name of the third specified major planet, must be opened; and three zodiac squares contiguous a trigon displaying the name of a fourth specified major planet, wherein two of the three squares display the name of the third specified major planet and the remaining one square displays the name of the first specified major planet, must be closed. |
| 34 | One zodiac square displaying the name of a first specified major planet and contiguous a trigon displaying the same name must be opened. |
| 35 | One zodiac square displaying the name of a first specified major planet and contiguous a trigon displaying the name of a second specified major planet must be opened. |

RULES OF THE GAME

The object, intent and purpose of the game, as previously set forth, and the manner in which the game may be played is set out for the convenience of the players in a booklet entitled "HOROSCOPE: Rules of the Game." The text of the booklet reads substantially as follows:

"Rules of the game for four players

"1. Each player selects what he wants to be:

FAME (MARS)

FORTUNE (MERCURY)

LOVE (VENUS)

POWER (JUPITER).

"Each player has three HOUSES on his side of the HOROSCOPE board:

MARS has CAPRICORN, AQUARIUS, and PISCES;

MERCURY has CANCER, LEO, and VIRGO:

JUPITER had LIBRA, SCORPIO, and SAGITTARIUS; and

VENUS has ARIES, TAURUS, and GEMINI.

"2. Each player locates his zodiac sign.

"To find your zodiac sign, use the HOROSCOPE game board to look up the month and day you were born. For example, if you were born between Sept. 23rd and Oct. 21st, you are a Libra.

"3. Each player opens his zodiac square,

"To open his zodiac square, a player places his knight on the zodiac square with his zodiac sign. For example, if your are a Virgo and you are playing under MARS (FAME), you place your knight on the zodiac square numbered 1 in the upper righthand corner; this knight is never moved throughout the game regardless of what happens. A player's zodiac square never closes, and it is possible for all players to have identical zodiac signs.

"4. Each player closes the eleven remaining zodiac squares on his side of the board.

"To close these eleven remaining zodiac squares, a player places one pawn on each of them.

"5. Next locate the HOUSE OF THE SUN and the HOUSE OF THE MOON for the day's date by using the DATE CHART below.

DATE CHART

| HOUSE OF THE SUN | Corresponding Sun Sign (Zodiac Square Number for All Players) | HOUSE OF THE MOON | Corresponding Moon Sign (Zodiac Square Number for All Players) |
|---|---|---|---|
| 1st HOUSE | 1 | 12th HOUSE | 12 |
| 2nd HOUSE | 2 | 11th HOUSE | 11 |
| 3rd HOUSE | 3 | 10th HOUSE | 10 |
| 4th HOUSE | 4 | 9th HOUSE | 9 |
| 5th HOUSE | 5 | 8th HOUSE | 8 |
| 6th HOUSE | 6 | 7th HOUSE | 7 |
| 7th HOUSE | 7 | 6th HOUSE | 6 |
| 8th HOUSE | 8 | 5th HOUSE | 5 |
| 9th HOUSE | 9 | 4th HOUSE | 4 |
| 10th HOUSE | 10 | 3rd HOUSE | 3 |
| 11th HOUSE | 11 | 2nd HOUSE | 2 |
| 12th HOUSE | 12 | 1st HOUSE | 1 |

"Under the DATE CHART when the SUn is in the 1st HOUSE, the Moon is in the 12th, HOUSE; and when the Sun is in the 2nd HOUSE, the Moon is in the 11th HOUSE; and so on.

"The Sun Signs and Moon Signs are zodiac square numbers which are listed on the HOROSCOPE board on each player's side. All players have identical Sun and Moon signs under the day's date.

"Each HOUSE OF THE SUN has the same calendar dates as one of the HOUSES on the HOROSCOPE game board. For example, if the date is Jan. 1st, which is between Dec. 21st and Jan. 20th, the calendar dates of the 10th HOUSE on the HOROSCOPE board, the HOUSE OF THE SUN is the 10th HOUSE; and for the same date, the HOUSE OF THE MOON is the 3rd HOUSE. Further, for Jan. 1st, each player's Sun Sign is #10; and each player's Moon Sign is #3.

"6. Now locate the HOUSE OF THE SUN and the HOUSE OF THE MOON for the day's time by using the TIME CHART below.

TIME CHART

| HOUSE OF THE SUN | Corresponding Sun Sign (Zodiac Square Number for All Players) | HOUSE OF THE MOON | Corresponding Moon Sign (Zodiac Square Number for All Players) |
|---|---|---|---|
| 1st HOUSE | 1 | 7th HOUSE | 7 |
| 2nd HOUSE | 2 | 8th HOUSE | 8 |
| 3rd HOUSE | 3 | 9th HOUSE | 9 |
| 4th HOUSE | 4 | 10th HOUSE | 10 |
| 5th HOUSE | 5 | 11th HOUSE | 11 |
| 6th HOUSE | 6 | 12th HOUSE | 12 |
| 7th HOUSE | 7 | 1st HOUSE | 1 |
| 8th HOUSE | 8 | 2nd HOUSE | 2 |
| 9th HOUSE | 9 | 3rd HOUSE | 3 |
| 10th HOUSE | 10 | 4th HOUSE | 4 |
| 11th HOUSE | 11 | 5th HOUSE | 5 |
| 12th HOUSE | 12 | 6th HOUSE | 6 |

"Under the TIME CHART when the Sun is in the 1st HOUSE, the Moon is in the 7th HOUSE; and when the Sun is in the 2nd HOUSE, the Moon is in the 8th HOUSE; and so on.

"If the time is 12 o'clock noon, which is between 12 A.M. and 2 P.M. on the HOROSCOPE board, the HOUSE OF THE SUN is the 2nd HOUSE (each player's Sun Sign would be #2); and the HOUSE OF THE MOON is the 8th HOUSE (each player's Moon Sign would be #8).

"7. After locating the HOUSE OF THE SUN and the HOUSE OF THE MOON for the day's date, place one of the kings in the HOUSE OF THE SUN; and place his queen in the HOUSE OF THE MOON. Similarly after locating the HOUSE OF THE SUN and the HOUSE OF THE MOON for the day's time, place the second king in the HOUSE OF THE SUN; and place his queen in the HOUSE OF THE MOON.

"If the day's date and/or time should change while the game is in progress, stop the game and make the necessary changes.

"Every HOROSCOPE game always has two HOUSES OF THE SUN and two HOUSES OF THE MOON at the beginning of each game. It is possible for the HOUSE OF THE SUN for the day's date and time to be identical; and it is possible also for the HOUSE OF THE MOON for the day's date and time to be identical.

"Each player has one zodiac sign (zodiac square), one or two Sun Signs (zodiac squares), and one or two Moon Signs (zodiac squares). For example, if you are a Virgo, the zodiac square numbered 1 is your zodiac sign. If the Sun is in the 1st HOUSE under the date of the HOROSCOPE game, your Sun Sign (and everyone else's Sun Sign) is the zodiac square numbered 1; and your Moon Sign (and everyone else's) for the date of the HOROSCOPE game is the zodiac square numbered 12 because the 12th HOUSE is automatically the HOUSE OF THE MOON if the 1st HOUSE is the HOUSE OF THE SUN (see DATE CHART). If the Sun is in the 1st HOUSE under the time of the HOROSCOPE game, your Sun Sign for the time is also numbered 1 (everyone else's Sun Sign is numbered 1); and your Moon Sign (and everyone else's) for the time is the zodiac square numbered 7 because when the Sun Sign for time is in the 1st HOUSE, the Moon Sign for time is automatically in the 7th HOUSE (see TIME CHART).

"8. Separate all HOROSCOPE game cards into three decks according to whether each card is a CHANCE, PLANET, or STAR card.

"a. Shuffle the CHANCE cards and place them face down on the area marked 'CHANCE CARD FACE DOWN.'

"b. Shuffle the PLANET cards and place them face down on the area marked 'PLANET CARD FACE DOWN.'

"c. Shuffle the STAR cards and place them face down on the area marked 'STAR CARD FACE DOWN.'

"9. Throw the dice to determine which person plays first.

"The highest number is first; the next highest is second; and the lowest is last. In case of a tie, each of the throwers who are tied throws again to break the tie.

"A variation of the game is to determine the order in which the players are to take their turns by simply starting with the person who throws the highest dice number and allowing the player to his right to follow him.

"10. The first player places the rook (the turn-piece) on the area marked 'ROOK' in his section of the HOROSCOPE board.

"For example, JUPITER's rook is placed in SCORPIO (8th HOUSE); MARS' rook is placed in AQUARIUS (11th HOUSE); VENUS' rook is placed in TAURUS (2nd HOUSE); and MERCURY's rook is placed in LEO (5th HOUSE).

"The purpose of the rook is to remind all players as to whose turn is in progress. Each player must place the rook in its appropriate HOUSE (area) before he begins play. If a player forgets to place the rook in its proper area before he plays, he must forfeit that turn.

"11. The first card drawn is the STAR card.

"A STAR card it also the first card drawn by each player when it is his turn to play. The player must follow, or other players must follow, the directions printed on the STAR card if possible.

"CHANCE cards may be drawn upon the directions of either the PLANET cards or of the STAR cards. PLANET cards are usually drawn upon the directions of the STAR cards. A zodiac square cannot be opened (or closed) unless a HOROSCOPE game card specifically states to open (or to close) a particular square or a CHANCE card is drawn which under Rules 14 through 17 of this booklet dictates such an opening (or closing).

"Each player must read aloud the directions on each of the HOROSCOPE cards before or while the card is being played. If a card states that another player is to close or to open a zodiac square, the other players must do so if possible. If the directions on a card cannot be followed by its player or other players, the card is void; and the rook is taken by the next player.

"12. The winner: A player wins the game when he closes all three HOUSES on his side of the HOROSCOPE board.

"If at any time during the game a player finds all twelve zodiac squares on his side of the board open, the game must stop; and that player must try to throw a double number on the dice to close one of his HOUSES. When closing a HOUSE, a player has three chances to try throwing a double number. Each player must close each of his three HOUSES is numerical order. For example, VENUS must close the 1st HOUSE first and the 3rd HOUSE last.

"When a HOUSE is closed, a bishop must be placed in the HOUSE to signify that it is closed. Anytime a player successfully closes a HOUSE, he must then in turn close eleven of his zodiac squares on his side of the game board and start over in order to close his next HOUSE.

"If a HOUSE is not successfully closed and must be left open after three throws of the dice, all of that player's zodiac squares must be closed except for the player's zodiac sign; and the player must then start over.

"13. A player may win the game even when it is not his turn to play.

For example, the rook is in VENUS' TAURUS; and the turn belongs to VENUS. VENUS then draws a STAR card that states all twelve signs under JUPITER must open. JUPITER then must open all twelve squares on his side of the HOROSCOPE board; but the rook stays in VENUS' TAURUS. JUPITER then attempts to close one of his three HOUSES by throwing a double on the dice. After JUPITER succeeds or fails to close one of his three HOUSES on his side of the HOROSCOPE board, VENUS resumes her turn unless JUPITER has already won or unless her turn is now ended. In the latter case, MERCURY places the rook in LEO to signify that it is his turn.

"Point system

"14. Under the point system, a player can receive a total of 1000 points per game. A maximum of 300 points is earned for closing each HOUSE on the first throw of the dice and 100 points for being the first to close all three HOUSES. If a player closes a HOUSE on the third throw of the dice, he receives 100 points; on the second throw of the dice, 200 points; and on the first throw of the dice, 300 points.

"Under the points system, a player can win the game (be the first to close all three HOUSES) but not have the most points. In such a case, a second game should be played; and the players should total up the points at the end of the first and second games. The person with the most total points after both games is the official winner even though he may not have received the extra 100 points for closing all three of his HOUSES first.

"CHANCE Cards

"14. When a CHANCE card is drawn, the corresponding zodiac square must open if it is not already open.

"For example, the two of hearts (2H) is turned up; then Virgo under VENUS must open.

"15. If a CHANCE card matches the number and suit of any player's zodiac sign, that player must open all twelve squares on his side of the HOROSCOPE board and throw the dice three times to attempt to close one of his HOUSES.

"16. If a CHANCE card matches an ace (ACE CLUBS on a CHANCE card matches 'ACE CLUBS' for MARS), all twelve zodiac squares of the player must open; and the player must throw the dice three times to try to close one of his three HOUSES.

"For example, the ace of diamonds (AD) is drawn; then all twelve zodiac squares of MERCURY must open. The player under MERCURY throws the dice in an attempt to close one of his HOUSES.

"17. If a CHANCE card matches the number and suit of a STAR card or of a PLANET card that has been last played and is now discarded face up on the HOROSCOPE board, all twelve zodiac squares of that player must open; and he must try to close one of his three HOUSES in three throws of the dice.

"For example, a STAR card is drawn and read jack of clubs (JC) and also tells the player to draw a CHANCE card which when turned up also reads jack of clubs (JC). Then all twelve zodiac squares of MARS must be opened, and MARS must throw the dice three times to close one of his three HOUSES.

"STAR and PLANET Cards

"18. When a STAR or PLANET game card is drawn, the corresponding zodiac square(s) must open (if closed) or must close (if open) in accordance with the directions printed on the card; if none of the directions of the card can be followed, the card is void; and the turn is over for that player.

"Most of the STAR cards and PLANET cards have a number in parentheses at the end of the card directions. The number is an indicator number telling the player or players of the approximate number of zodiac squares to be opened or closed by that play of the card. For example, a card reads: 'Mercury opens in 3rd and 4th HOUSE (3).' The indicator number is the (3); therefore, three or approximately three zodiac squares would open jointly under VENUS and MERCURY.

"Rules of the game for two players only

"19. If only two players choose to play HOROSCOPE, one must take both VENUS and MERCURY; and the other must take MARS and JUPITER.

"Each player still needs to close only three of the six HOUSES to win the game. Each HOUSE must be closed in numerical order; further, all other previously mentioned rules still apply.

"Rules of the game for three players

"20. If three players choose to play HOROSCOPE, one player must take MARS; another player JUPITER; and the last player VENUS and MERCURY combined.

"All previously mentioned rules still apply.

"Rules of the game for more than four players

"21. If more than four players choose to play HOROSCOPE, the rules are modified as follows:

"A fifth player must choose to be either NEPTUNE, PLUTO, SATURN, or URANUS. NEPTUNE is a combination of one HOUSE under MARS (FAME) and two HOUSES under VENUS (LOVE). PLUTO is a combination of one HOUSE under VENUS (LOVE) and two HOUSES under MERCURY (FORTUNE). SATURN is a combination of one HOUSE under MERCURY (FORTUNE) and two HOUSES under JUPITER (POWER). URANUS is a combination of one HOUSE under JUPITER (POWER) and two HOUSES under MARS (FAME).

"NEPTUNE thus has PISCES, ARIES, and TAURUS;

"PLUTO has GEMINI, CANCER, and LEO;

"SATURN has VIRGO, LIBRA, and SCORPIO; and

"URANUS has SAGITTARIUS, CAPRICORN, and AQUARIUS.

"Each player must close each of his three HOUSES in numerical order with one exception: NEPTUNE must close the 12th HOUSE (PISCES) first and the 2nd HOUSE (TAURUS) last.

"It is possible for NEPTUNE, PLUTO, SATURN, or URANUS to win the game of HOROSCOPE without ever closing one of his HOUSES. For example, if the fifth player chooses to be SATURN, the 6th HOUSE (VIRGO) under MERCURY (FORTUNE) and the 7th and 8th HOUSES (LIBRA and SCORPIO, respectively) under JUPITER must be closed in order for SATURN to win the game. If the 7th and 8th HOUSES are first closed by JUPITER and the 6th HOUSE is then closed by VENUS, both VENUS and SATURN win the game. Tie games are thus quite possible with more than four players.

"When more than four players are playing HOROSCOPE, as many as three knights may occupy one side of the HOROSCOPE board so that a player may need to close only nine or ten zodiac squares. It is also possible for two players to have two knights on the same zodiac square (sign). In such a case, when a CHANCE card is drawn with the same number and suit as the shared zodiac square (sign), the two players have to throw the dice for the use of the CHANCE card; the player throwing the higher of two numbers on the dice wins the play.

"If an ace of a CHANCE card suit is drawn and there are two players who match the ace, each of them must throw the dice one, and only once, to see who will use the ace. The thrower with the highest number uses the ace on the CHANCE card. In cases of tied numbers, both players must throw the dice again to break the tie. For example, if the ace of spades (AS) is drawn under the CHANCE cards, either JUPITER or SATURN must open all of his respective zodiac squares. The highest thrower, as determined by a single throw of the dice, uses the ace.

"If a CHANCE card matches the number and suit of a STAR card or of a PLANET card that has been last played and there are two players who have identical zodiac squares (signs) that also match the CHANCE card's number and suit, the two players must throw the dice to determine who will use the CHANCE card. For example, a STAR card is turned up and reads jack of clubs (JS) and also tells the player to draw a CHANCE card which when turned up reads jack of clubs (JC). Both MARS and URANUS would be eligible to open all twelve of their respective zodiac squares; exactly which player, MARS or URANUS, uses the CHANCE card is once again determined by a higher, single throw of the dice."

Chart No. 1

Legendary matter on individual STAR cards

| STAR card category | Title(s): designation (single or double); description, if any | Statement(s) | Command; composite symbol, if any |
|---|---|---|---|
| 1 | "HALLEY'S COMET ARIES Single" "Halley's Comet is is 1st HOUSE." | "All 12 signs under VENUS must open. (12)" | "If ARIES is closed, draw again. (STAR)" |
| 1 | "HALLEY'S COMET TAURUS Single" "Halley's Comet is in 2nd HOUSE." | "All 12 signs under VENUS must open. (12)" | "If TAURUS is closed, draw again. (STAR)" |
| 1 | "HALLEY'S COMET GEMINI Single" "Halley's Comet is in 3rd HOUSE." | "All 12 signs under VENUS must open. (12)" | "If GEMINI is closed, draw again. (STAR)" |
| 1 | "HALLEY'S COMET CANCER Single" "Halley's Comet is in 4th HOUSE." | "All 12 signs under MERCURY must open. (12)" | "If CANCER is closed, draw again. (STAR)" |
| 1 | "HALLEY'S COMET LEO Single" "Halley's Comet is in 5th HOUSE." | "All 12 signs under MERCURY must open. (12)" | "If LEO is closed, draw again. (STAR)" |
| 1 | "HALLEY'S COMET VIRGO Single" "Halley's Comet is in 6th HOUSE." | "All 12 signs under MERCURY must open. (12)" | "If VIRGO is closed, draw again. (STAR)" |
| 1 | "HALLEY'S COMET LIBRA Single" "Halley's Comet is in 7th HOUSE." | "All 12 signs under JUPITER must open. (12)" | "If LIBRA is closed, draw again. (STAR)" |
| 1 | "HALLEY'S COMET SCORPIO Single" "Halley's Comet is in 8th HOUSE." | "All 12 signs under JUPITER must open. (12)" | "If SCORPIO is closed, draw again. (STAR)" |
| 1 | "HALLEY'S COMET SAGITTARIUS Single" "Halley's Comet is in 9th HOUSE." | "All 12 signs under JUPITER must open. (12)" | "If SAGITTARIUS is closed, draw again. (STAR)" |
| 1 | "HALLEY'S COMET | "All 12 signs under | "If CAPRI- |

-continued

Chart No. 1

Legendary matter on individual STAR cards

| STAR card category | Title(s): designation (single or double); description, if any | Statement(s) | Command; composite symbol, if any |
|---|---|---|---|
| | CAPRICORN Single" "Halley's Comet is in 10th HOUSE." | MARS must open. (12)" | CORN is closed, draw again. (STAR)" |
| 1 | "HALLEY'S COMET AQUARIUS Single" "Halley's Comet is in 11th HOUSE." | "All 12 signs under MARS must open. (12)" | "If AQUARIUS is closed, draw again. (STAR)" |
| 1 | "HALLEY'S COMET PISCES Single" "Halley's Comet is in 12th HOUSE." | "All 12 signs under MARS must open. (12)" | "If PISCES is closed, draw again. (STAR)" |
| 2 | "FALLING STAR Single" | "VENUS opens any 2 signs under VENUS. (2)" | "Draw again. (CHANCE)" "KD" |
| 2 | "BLAZING STAR Single" | "MERCURY opens any 2 signs under MERCURY. (2)" | "Draw again. (CHANCE)" "JC" |
| 2 | "FLAMING STAR Single" | "JUPITER opens any 2 signs under JUPITER. (2)" | "Draw again. (CHANCE)" "9C" |
| 2 | "SHOOTING STAR Single" | "MARS opens any 2 signs under MARS. (2)" | "Draw again. (CHANCE)" "10D" |
| 3 | "FIXED QUADRUPLICITY Single" | "All 4 TAURI of 2nd HOUSE must open under VENUS. (4)" | "Draw again. (CHANCE)" "6D" |
| 3 | "MUTABLE QUADRUPLICITY Single" | "All 4 GEMINI of 3rd HOUSE under VENUS must open. (4)" | "Draw again. (CHANCE)" "2D" |
| 3 | "FIXED QUADRUPLICITY Single" | "All 4 LEOS of 5th HOUSE under MERCURY must open. (4)" | "Draw again. (CHANCE)" "KH" |
| 3 | "MUTABLE QUADRUPLICITY Single" | "All 4 VIRGOS of 6th HOUSE under MERCURY must open. (4)" | "Draw again. (CHANCE)" "KC" |
| 3 | "FIXED QUADRUPLICITY Single" | "All 4 SCORPIOS of 8th HOUSE under JUPITER must open. (4)" | "Draw again. (CHANCE)" "8H" |
| 3 | "MUTABLE QUADRUPLICITY Single" | "All 4 SAGITTARII of 9th HOUSE under JUPITER must open. (4)" | "Draw again. (CHANCE)" "2C" |
| 3 | "FIXED QUADRUPLICITY Single" | "All 4 AQUARIANS of 11th HOUSE under MARS must open. (4)" | "Draw again. (CHANCE)" "10C" |
| 3 | "MUTABLE QUADRUPLICITY Single" | "All 4 PISCES of 12th HOUSE under MARS must open. (4)" | "Draw again. (CHANCE)" "3S" |
| 4 | "MOON PERIGEES Courage Single" | "All 4 CANCERS under MERCURY must open except in HOUSE of Moon. (4)" | "Draw again. (STAR)" |
| 4 | "¾ MOON Law Single" | "All 4 LIBRAS under JUPITER must open except in HOUSE of Moon. (4)" | "Draw again. (PLANET)" |
| 4 | "MOON APOGEES | "All 4 AQUARIANS | "Draw |

-continued

Chart No. 1

Legendary matter on individual STAR cards

| STAR card category | Title(s): designation (single or double); description, if any | Statement(s) | Command; composite symbol, if any |
|---|---|---|---|
| | Travel Single" | under MARS must open except in HOUSE of Sun. (4)" | again. (PLANET)" |
| 5 | "GOLDEN FLEECE Double" | "All 4 ARIES of 1st HOUSE must open under VENUS. (4)" | "Draw again. (CHANCE)" "8C" |
| | "PSYCHICS Double" | "All Sagittarius signs under all players must open. (4)" | |
| 5 | "DIOSCURI Double" | "All 4 GEMINI of 3rd HOUSE under VENUS must open. (4)" | "Draw again. (CHANCE)" "5D" |
| | "FRIENDSHIP Double" | "All Capricorn signs under all players must open. (4)" | |
| 5 | "EGYPTIAN SPHINX Double" | "All 4 VIRGOS of 6th HOUSE under MERCURY must open. (4)" | "Draw again. (CHANCE)" "QC" |
| | "HEALING Double" | "All Leo signs must open under all players. (4)" | |
| 5 | "TOWER OF BABEL Double" | "All 4 LIBRA of the 7th HOUSE under JUPITER must open. (4)" | "Draw again. (CHANCE)" "4D" |
| | "SOCIAL POSITION Double" | "All Pisces signs must open under all players. (4)" | |
| 5 | "ASIAN SCORPION Double" | "All 4 SCORPIOS of the 8th HOUSE must open under JUPITER. (4)" | "Draw again. (CHANCE)" "2H" |
| | "PHILOSOPHY Double" | "All Cancer signs must open under all players. (4)" | |
| 5 | "CHINESE DRAGON Double" | "All 4 CAPRICORNS of 10th HOUSE must open. (4)" | "Draw again. (CHANCE)" |
| | "ARBITRATION Double" | "All Taurus signs must open under all players. (4)" | "JD" |
| 6 | "CRETAN BULL Double" | "All 4 TAURII of 2nd HOUSE must open under VENUS. (4)" | "Draw again. (STAR)" |
| | "ODYSSEY Double" | "All Capricorn signs must close under all players except VENUS. (3)" | |
| 6 | "CYRIAN CRAB Double" | "All 4 CANCERS of 4th HOUSE must open under MERCURY. (4)" | "Draw again. (STAR)" |
| | "FORTITUDE Double" | "All Scorpio signs must close under all players. (4)" | |
| 6 | "PERSIAN LION Double" | "All 4 LEOS of 5th HOUSE must open under MERCURY. (4)" | "Draw again. (STAR)" |
| | "STRENGTH Double" | "All Virgo signs must close under all players. (4)" | |
| 6 | "GRECIAN CENTAUR Double" | "All 4 SAGITTARII of 9th HOUSE under JUPITER must open. (4)" | "Draw again. (STAR)" |

-continued

Chart No. 1

Legendary matter on individual STAR cards

| STAR card category | Title(s): designation (single or double); description, if any | Statement(s) | Command; composite symbol, if any |
|---|---|---|---|
| | "SEARCHING Double" | "All Aries signs must close under all players. (4)" | |
| 6 | "ARABIAN FIREBIRD Double" | "All 4 AQUARIANS of 11th HOUSE must open under MARS. (4)" | "Draw again. (STAR)" |
| | "INVENTIVENESS Double" | "All Gemini signs must close under all players. (4)" | |
| 6 | "SEA OF GALILEE Double" | "All 4 PISCES of 12th HOUSE under MARS must open. (4)" | "Draw again. (STAR)" |
| | "SPIRITUALISM Double" | "All Libra signs must close under all players. (4)" | |
| 7 | "CARDINAL QUADRUPLICITY Double" | "All 4 ARIES of 1st HOUSE under VENUS must open. (4) Capricorn sign under MARS must close. (1)" | none |
| | "LOVE Double" | "Libra sign under JUPITER must close. (1) Cancer sign under MERCURY must close. (1)" | |
| 7 | "CARDINAL QUADRUPLICITY Double" | "All 4 CANCERS of 4th HOUSE under MERCURY must open. (4) Aries sign under VENUS must close. (1)" | none |
| | "FORTUNE Double" | "Capricorn sign under MARS must close. (1) Libra sign under JUPITER must close. (1)" | |
| 7 | "CARDINAL QUADRUPLICITY Double" | "All 4 LIBRAS of 7th HOUSE under JUPITER must open. (4) Cancer sign under MERCURY must close. (1)" | none |
| | "POWER Double" | "Aries sign must close under VENUS. (1) Capricorn sign must close under MARS. (1)" | |
| 7 | "CARDINAL QUADRUPLICITY Double" | "All 4 CAPRICORNS of 10th HOUSE under MARS must open. (4) Libra sign under JUPITER must close. (1)" | none |
| | "FAME Double" | "Cancer sign under MERCURY must close. (1) Aries sign under VENUS must close. (1)" | |
| 8 | "LUNAR ECLIPSE Stamina Single" "Partial lunar eclipse of East" | "All Leo signs of East must open. (2)" | "Draw again. (PLANET)" |
| 8 | "LUNAR ECLIPSE Stamina Single" | "All Leo signs of West must open. (2)" | "Draw again. (PLANET)" |

-continued

Chart No. 1

Legendary matter on individual STAR cards

| STAR card category | Title(s): designation (single or double); description, if any | Statement(s) | Command; composite symbol, if any |
|---|---|---|---|
| | "Total lunar eclipse of West" | | |
| 8 | "LUNAR ECLIPSE Writing Single" "Total lunar eclipse of East" | "All Scorpio signs of East must open. (2)" | "Draw again. (PLANET)" |
| 8 | "LUNAR ECLIPSE Writing Single" "Partial lunar eclipse of West" | "All Scorpio signs of West must open. (2)" | "Draw again. (PLANET)" |
| 8 | "DOG STAR Single" "Sirius dims in northeast." | "All Capricorns of East must open. (2)" | "Draw again. (CHANCE)" "9D" |
| 8 | "DOG STAR Single" "Sirius brightens in southwest." | "All Cancers of West must open. (2)" | "Draw again. (CHANCE)" "4C" |
| 9 | "METEOR SHOWER Fidelity Single" | "All Gemini signs under all players must open except in HOUSE of Moon. (4)" | "Draw again. (PLANET)" |
| 9 | "CRESCENT MOON Health Single" | "All Virgo signs must open except in HOUSE of Sun. (4)" | "Draw again. (PLANET)" |
| 9 | "FULL MOON Hunting Single" | "All Sagittarius signs must open except in HOUSE of Moon. (4)" | "Draw again. (PLANET)" |
| 10 | "HALF MOON Wealth Single" | "All Aries signs under VENUS and MARS must open except in HOUSE of Moon. (2)" | "Draw again. (PLANET)" |
| 10 | "NEW MOON Adventure Single" | "All Taurus signs under JUPITER and MARS must open except in HOUSE of Moon. (2)" | "Draw again. (PLANET)" |
| 10 | "¼ MOON Politics Single" | "All Capricorn signs under VENUS and MERCURY must open except in HOUSE of Sun. (2)" | "Draw again. (PLANET)" |
| 10 | "HALF MOON Idealism Single" | "All Pisces signs under JUPITER and MERCURY must open except in HOUSE of Sun. (2)" | "Draw again (PLANET)" |
| 11 | "SUN SIGNS DATE Double" | "If Sun is in 1st HOUSE and Moon is in 12th HOUSE, all Aries and Pisces signs must open. (8)" | "Draw again. (PLANET)" |
| | "SUN SIGNS TIME Double" | "If Sun is in 1st HOUSE and Moon is in 7th HOUSE, all Aries signs and Libra signs must open. (8)" | |
| 11 | "SUN SIGNS DATE Double" | "If Sun is in 2nd HOUSE and Moon is in 11th HOUSE, all Taurus signs and Aquarius signs | "Draw again. (PLANET)" |

-continued

Chart No. 1

Legendary matter on individual STAR cards

| STAR card category | Title(s): designation (single or double); description, if any | Statement(s) | Command; composite symbol, if any |
|---|---|---|---|
| | | must open. (8)" | |
| | "SUN SIGNS TIME Double" | "If Sun is in 2nd HOUSE and Moon is in 8th HOUSE, all Taurus signs and Scorpio signs must open. (8)" | |
| 11 | "SUN SIGNS DATE Double" | "If Sun is in 3rd HOUSE and Moon is in 10th HOUSE, all Gemini signs and Capricorn signs must open. (8)" | "Draw again. (PLANET)" |
| | "SUN SIGNS TIME Double" | "If Sun is in 3rd HOUSE and Moon is in 9th HOUSE, all Gemini signs and Sagittarius signs must open. (8)" | |
| 11 | "SUN SIGNS DATE Double" | "If Sun is in 4th HOUSE and Moon is in 9th HOUSE, all Cancer and Sagittarius signs must open. (8)" | "Draw again. (PLANET)" |
| | "SUN SIGNS TIME Double" | "If Sun is in 4th HOUSE and Moon is in 10th HOUSE, all Cancer signs and Capricorn signs must open. (8)" | |
| 11 | "SUN SIGNS DATE Double" | "If Sun is in 5th HOUSE and Moon is in 8th HOUSE, all Scorpio signs and Leo signs must open. (8)" | "Draw again. (PLANET)" |
| | "SUN SIGNS TIME Double" | "If Sun is in 5th HOUSE and Moon is in 11th HOUSE, all Leo signs and Aquarius signs must open. (8)" | |
| 11 | "SUN SIGNS DATE Double" | "If Sun is in 6th HOUSE and Moon is in 7th HOUSE, all Libra signs and Virgo signs must open. (8)" | "Draw again. (PLANET)" |
| | "SUN SIGNS TIME Double" | "If Sun is in 6th HOUSE and Moon is in 12th HOUSE, all Pisces signs and Virgo signs must open. (8)" | |
| 11 | "SUN SIGNS DATE Double" | "If Sun is in 7th HOUSE and Moon is in 6th HOUSE, all Virgo signs and Libra signs must open. (8)" | "Draw again. (PLANET)" |
| | "SUN SIGNS TIME Double" | "If Sun is in 7th HOUSE and Moon is in 1st HOUSE, all Libra signs and Aries signs must open. (8)" | |
| 11 | "SUN SIGNS DATE Double" | "If Sun is in 8th HOUSE and Moon is in 5th HOUSE, all Leo signs and Scorpio signs must open. (8)" | "Draw again. (PLANET)" |
| | "SUN SIGNS TIME | "If Sun is in 8th HOUSE and Moon is | |

-continued

Chart No. 1

Legendary matter on individual STAR cards

| STAR card category | Title(s): designation (single or double); description, if any | Statement(s) | Command; composite symbol, if any |
|---|---|---|---|
| | Double" | in 2nd HOUSE, all Taurus signs and Scorpio signs must open. (8)" | |
| 11 | "SUN SIGNS DATE Double" | "If Sun is in 9th HOUSE and Moon is in 4th HOUSE, all Cancer signs and Sagittarius signs must open. (8)" | "Draw again. (PLANET)" |
| | "SUN SIGNS TIME Double" | "If Sun is in 9th HOUSE and Moon is in 3rd HOUSE, all Gemini signs and Sagittarius signs must open. (8)" | |
| 11 | "SUN SIGNS DATE Double" | "If Sun is in 10th HOUSE and MOON is in 3rd HOUSE, all Gemini and Capricorn signs must open. (8)" | "Draw again. (PLANET)" |
| | "SUN SIGNS TIME Double" | "If Sun is in 10th HOUSE and Moon is in 4th HOUSE, all Cancer signs and Capricorn signs must open. (8)" | |
| 11 | "SUN SIGNS DATE Double" | "If Sun is in 11th HOUSE and Moon is in 2nd HOUSE, all Taurus signs and Aquarius signs must open. (8)" | "Draw again. (PLANET)" |
| | "SUN SIGNS TIME Double" | "If Sun is in 11th HOUSE and Moon is in 5th HOUSE, all Leo signs and Aquarius signs must open. (8)" | |
| 11 | "SUN SIGNS DATE Double" | "If Sun is in 12th HOUSE and Moon is in 1st HOUSE, all Aries signs and Pisces signs must open. (8)" | "Draw again. (PLANET)" |
| | "SUN SIGNS TIME Double" | "If Sun is in 12th HOUSE and Moon is in 6th HOUSE, all Pisces signs and Virgo signs must open. (8)" | |
| 12 | "FIRE TRIPLICITY Double" "LOVE Double" | "All Aries signs must close except under VENUS. (3)" "All Leo and Sagittarius signs must close under all players. (8)" | "Draw again. (PLANET)" |
| 12 | "EARTH TRIPLICITY Double" "LOVE Double" | "All Taurus signs must close except under VENUS. (3)" "All Capricorn and Virgo signs must close under all players. (8)" | "Draw again. (PLANET)" |
| 12 | "AIR TRIPLICITY Double" "LOVE Double" | "All Gemini signs must close except under VENUS. (3)" "All Aquarius and Libra signs must close under all players. (8)" | "Draw again. (PLANET)" |
| 12 | "WATER TRIPLICITY | "All Cancer signs must close except | "Draw again. |

-continued

Chart No. 1

Legendary matter on individual STAR cards

| STAR card category | Title(s): designation (single or double); description, if any | Statement(s) | Command; composite symbol, if any |
|---|---|---|---|
| | Double" | under MERCURY. (3)" | (PLANET)" |
| | "FORTUNE Double" | "All Pisces and Scorpio signs must close under all players. (8)" | |
| 12 | "FIRE TRIPLICITY Double" "FORTUNE Double" | "All Leo signs must close except under MERCURY. (3)" "All Aries and Sagittarius signs must close under all players. (8)" | "Draw again. (PLANET)" |
| 12 | "EARTH TRIPLICITY Double" | "All Virgo signs must close except under MERCURY. (3)" | "Draw again. (PLANET)" |
| | "FORTUNE Double" | "All Capricorn and Taurus signs must close. (8)" | |
| 12 | "AIR TRIPLICITY Double" | "All Libra signs must close except under JUPITER. (3)" | "Draw again. (PLANET)" |
| | "POWER Double" | "All Aquarius and Gemini signs must close under all players. (8)" | |
| 12 | "WATER TRIPLICITY Double" | "All Scorpio signs must close except under JUPITER. (3)" | "Draw again. (PLANET)" |
| | "POWER Double" | "All Cancer and Pisces signs must close under all players. (8)" | |
| 12 | "FIRE TRIPLICITY Double" | "All Sagittarius signs must close except under JUPITER. (3)" | "Draw again. (PLANET)" |
| | "POWER Double" | "All Aries and Leo signs under all players must close. (8)" | |
| 12 | "EARTH TRIPLICITY Double" "FAME Double" | "All Capricorn signs must close except under MARS. (3)" "All Taurus and Virgo signs must close. (8)" | "Draw again. (PLANET)" |
| 12 | "AIR TRIPLICITY Double" "FAME Double" | "All Aquarius signs must close except under MARS. (3)" "All Gemini and Libra signs must close under all players. (8)" | "Draw again. (PLANET)" |
| 12 | "WATER TRIPLICITY Double" "FAME Double" | "All Pisces signs must close except under MARS. (3)" "All Cancer and Scorpio signs must close under all players. (8)" | "Draw again. (PLANET)" |
| 13 | "SUNSPOTS Single" | "All Fire signs under all players must open. (12)" | "Draw again. (CHANCE)" "4S" |
| 14 | "SOLAR ECLIPSE Single" "Total solar eclipse of East" | "All Air signs of East must open. (6)" | "Draw again. (CHANCE)" "5C" |
| 14 | "SOLAR ECLIPSE Single" | "All Water signs of East must | "Draw again. |

-continued

Chart No. 1

Legendary matter on individual STAR cards

| STAR card category | Title(s): designation (single or double); description, if any | Statement(s) | Command; composite symbol, if any |
|---|---|---|---|
| | "Partial solar eclipse of East" | open. (6)" | (CHANCE)" "10H" |
| 15 | "LUNAR BOWS Single" | "All 4 Mutable signs under MERCURY must close except in HOUSE of Moon. (4)" | "Draw again. (STAR)" |
| 15 | "SOLAR FLARES Single" | "All 4 Cardinal signs under JUPITER must close except in HOUSE of Sun. (4)" | "Draw again. (PLANET)" |
| 15 | "SOLAR BOWS Single" | "All 4 Fixed signs under MARS must close except in HOUSE of Sun. (4)" | "Draw again. (STAR)" |

Chart No. 2

Legendary matter on individual PLANET cards

| PLANET card category | Title(s); designation (single or double); description, if any | Statement(s) | Command; composite symbol, if any |
|---|---|---|---|
| 1 | "LOVE SQUARES Single" "VENUS and MERCURY are conjunct evening stars of East south of Sun." | "All 12 squares under VENUS must open. (12)" | none |
| 1 | "FORTUNE SQUARES Single" "VENUS and MERCURY are conjuct evening stars of West north of Sun." | "All 12 squares under MERCURY must open. (12)" | none |
| 1 | "POWER SQUARES Single" "JUPITER and MARS are conjunct morning stars of West." | "All 12 squares under JUPITER must open. (12)" | none |
| 1 | "FAME SQUARES Single" "JUPITER and MARS are conjunct evening stars of East." | "All 12 squares under MARS must open. (12)" | none |
| 2 | "LOVE SQUARES Single" "JUPITER is morning star of West. MERCURY and VENUS are conjunct morning stars of East south of Sun." | "All squares must close under all players except squares open under VENUS. (36)" | none |
| 2 | "FORTUNE SQUARES Single" "MARS is evening star of East. MERCURY and VENUS are conjunct evening stars of West north of Sun." | "All squares must close under all players except squares open under MERCURY. (36)" | none |
| 2 | "POWER SQUARES Single" "JUPITER is morning star of East, and MERCURY | "All squares must close under all players except squares open under JUPITER. | none |

-continued

Chart No. 2

Legendary matter on individual PLANET cards

| PLANET card category | Title(s); designation (single or double); description, if any | Statement(s) | Command; composite symbol, if any |
|---|---|---|---|
| | and VENUS are morning stars of East north of Sun." | (36)" | |
| 2 | "FAME SQUARES Single" "MARS is evening star of East, and MERCURY and VENUS are evening stars of West south of Sun." | "All squares under all players must close except squares open under MARS. (36)" | none |
| 3 | "ZODIAC SQUARES Double" "MERCURY and VENUS are aligned morning stars of East south of Sun." "ZODIAC SQUARES Double" "JUPITER is morning star of West." | "All squares must close except for each player's zodiac square. (48) Each player's Sun and Moon squares must open. (16)" | "Draw again. (PLANET)" |
| 3 | "ZODIAC SQUARES Double" "MERCURY and VENUS are aligned evening stars of West north of Sun." "ZODIAC SQUARES Double" "MARS is evening star of West." | "All squares must close except for each player's zodiac square. (48) Each player's Sun and Moon squares must open. (16)" | "Draw again. (PLANET)" |
| 4 | "FORTUNE SQUARES Single" "VENUS and MERCURY are aligned morning stars of East south of Sun." | "First 6 squares under MERCURY must open. (6)" | "Draw again. (CHANCE)" "3H" |
| 5 | "POWER SQUARES Double" "JUPITER and MARS are aligned morning stars of West." | "First 6 signs under JUPITER must open. (6)" | "Draw again. (CHANCE)" |
| | "FAME SQUARES Double" "JUPITER and MARS are aligned stars of West." | "First 6 squares under MARS must open. (6)" | |
| 6 | "INVERSION Single" "VENUS inverts, goes behind the Sun." | "Last 6 squares under VENUS must open. (6)" | "Draw again. (CHANCE)" "QS" |
| 6 | "INVERSION Single" "MERCURY inverts, goes behind the Sun." | "Last 6 squares under MERCURY must open. (6)" | "Draw again. (CHANCE)" "10S" |
| 6 | "INVERSION Single" "JUPITER inverts, goes behind the Sun." | "Last 6 squares under JUPITER must open. (6)" | "Draw again. (CHANCE)" "QH" |
| 6 | "INVERSION Single" "MARS inverts, goes behind the Sun." | "Last 6 squares under MARS must open. (6)" | "Draw again. (CHANCE)" "5S" |
| 7 | "LOVE SQUARES Double" "VENUS is evening star of West north of Sun." | "Squares #5, 6, 7; 8 under VENUS must open. (4)" | "Draw again. (CHANCE)" "7H" |

-continued

Chart No. 2

Legendary matter on individual PLANET cards

| PLANET card category | Title(s); designation (single or double); description, if any | Statement(s) | Command; composite symbol, if any |
|---|---|---|---|
| | "MARS is evening star of East." | "Last 4 squares of VENUS must open. (4)" | |
| 8 | "FORTUNE SQUARES Double" "VENUS is evening star of West south of Sun." "POWER SQUARES Double" "MARS is evening star of East." | "Squares #5, 6, 7; 8 under MERCURY must open. (4)" "Last 4 squares under JUPITER must open. (4)" | "Draw again. (CHANCE)" "6H" |
| 9 | "LOVE SQUARES Single" "VENUS is evening star of West north of Sun." | "Squares #8, 9; 10 open under VENUS. (3)" | "Draw again. (CHANCE)" "7D" |
| 10 | "LOVE SQUARES Single" "MERCURY is evening star of West north of Sun." | "Squares #1, 11; 12 open under VENUS. (3)" | "Draw again. (CHANCE)" "9H" |
| 10 | "FORTUNE SQUARES Single" "JUPITER is morning star of West." | "Squares #2, 3; 4 must open under MERCURY. (3)" | "Draw again. (CHANCE)" "7S" |
| 10 | "POWER SQUARES Single" "JUPITER SQUARES Single" "MARS is evening star of East." | "Squares #5, 6; 7 open under JUPITER. (3)" | "Draw again. (CHANCE)" "JS" |
| 10 | "POWER SQUARES Single" "VENUS is morning star of East south of Sun." | "Squares #8, 9; 10 open under JUPITER. (3)" | "Draw again. (CHANCE)" "2S" |
| 10 | "FAME SQUARES Single" "VENUS is morning star of East north of Sun." | "Squares #8, 9; 10 open under MARS. (3)" | "Draw again. (CHANCE)" "9S" |
| 11 | "FORTUNE SQUARES Double" "MERCURY is morning star of East south of Sun." "POWER SQUARES Double" | "Squares #11; 12 must open under MERCURY. (2)" "Squares #1, 11; 12 must open under JUPITER. (3)" | "Draw again. (CHANCE)" "5H" |
| 12 | "LOVE SQUARES Double" "VENUS and MERCURY are evening stars of West north of Sun." | "Squares #8, 9; 10 must close under VENUS. (3)" "Squares #1, 11; 12 must close under VENUS. (3)" | "Draw again. (CHANCE)" "6S" |
| 13 | "FAME SQUARES Double" "JUPITER and MARS are evening stars of East." "POWER SQUARES Double" | "Squares #2, 3; 4 must close under MARS. (3)" "Squares #5, 6; 7 must close under JUPITER. (3)" | "Draw again. (CHANCE)" "KS" |
| 14 | "POWER SQUARES Double" "VENUS is morning star of East." "MERCURY is morning star of East south of Sun." | "Squares #8, 9; 10 must open under JUPITER. (3)" "Squares #1, 11; 12 must open under JUPITER. (3)" | "Draw again. (CHANCE)" "QD" |
| 15 | "FORTUNE SQUARES | "Squares #2, 3; | "Draw |

-continued

Chart No. 2

Legendary matter on individual PLANET cards

| PLANET card category | Title(s); designation (single or double); description, if any | Statement(s) | Command; composite symbol, if any |
|---|---|---|---|
| | Double" "JUPITER and MARS are morning stars of West." | 4 must close under MERCURY. (3)" "Squares #5, 6; 7 must close under MERCURY. (3)" | again. (CHANCE)" "8S" |
| 16 | "FAME SQUARES Double" "JUPITER is evening star of East." "LOVE SQUARES Double" "VENUS is evening star of West." | "Squares #2, 3; 4 must open under MARS. (3)" "Squares #8, 9; 10 must close under VENUS. (3)" | "Draw again. (CHANCE)" "JH" |
| 17 | "LOVE SQUARES Triple" "VENUS is evening star of West." "FAME SQUARES POWER SQUARES Triple" "MARS is evening star of East." | "Squares #8, 9; 10 under VENUS must open. (3)" "Squares #5, 6; 7 under MARS must open. (3) Squares #5, 6; 7 under JUPITER must open. (3)" | "Draw again. (CHANCE)" "4H" |
| 18 | "LOVE SQUARES Double" "VENUS is evening star of West." "FAME SQUARES Double" "MERCURY is evening star of West north of Sun." | "Squares #8, 9; 10 under VENUS must open. (3) Squares #1, 11; 12 under VENUS must open. (3)" "Squares #11; 12 under MARS must open. (2)" | none |
| 19 | "LOVE SQUARES Triple" "VENUS is evening star of West." "FAME SQUARES POWER SQUARES Triple" "JUPITER and MARS are evening stars of East." | "Squares #8, 9; 10 must open under VENUS. (3)" "Squares #5, 6; 7 under MARS must close. (3) Squares #5, 6; 7 under JUPITER must close. (3) Squares #2, 3; 4 under MARS must open. (3)" | none |
| 19 | "LOVE SQUARES Triple" "VENUS and MERCURY are evening stars of West." "FAME SQUARES POWER SQUARES Triple" "JUPITER and MARS are evening stars of East." | "Squares #8, 9; 10 must open under VENUS. (3)" "Squares #5, 6; 7 under MARS must close. (3) Squares #5, 6; 7 under JUPITER must close. (3) Squares #2, 3; 4 under MARS must open. (3)" | none |
| 20 | "FAME SQUARES POWER SQUARES Triple" "MARS is evening star of East." "LOVE SQUARES Triple" "MERCURY is evening star of West north of Sun." | "Squares #5, 6; 7 must open under MARS. (3) Squares #5, 6; 7 must open under JUPITER. (3)" "Square #1 must open under VENUS. (1)" | none |
| 21 | "POWER SQUARES Double" "VENUS and MERCURY | "Squares #1, 11; 12 must close under JUPITER. (3) | none |

-continued

Chart No. 2

Legendary matter on individual PLANET cards

| PLANET card category | Title(s); designation (single or double); description, if any | Statement(s) | Command; composite symbol, if any |
|---|---|---|---|
| | are morning stars of East south of Sun." "FORTUNE SQUARES Double" | Squares #8, 9; 10 must close under JUPITER. (3)" "Squares #11; 12 must close under MERCURY. (2)" | |
| 22 | "FORTUNE SQUARES POWER SQUARES Triple" "JUPITER and MARS are morning stars of West." "POWER SQUARES Triple" "VENUS is morning star of East." | "Squares #2, 3; 4 under MERCURY must open. (3) Squares #5, 6; 7 under JUPITER must open. (3)" "Squares #8, 9; 10 under JUPITER must close. (3)" | none |
| 23 | "FAME SQUARES Triple" "JUPITER is evening star of East." "FORTUNE SQUARES LOVE SQUARES Triple" "MERCURY is evening star of West." | "Squares #2, 3; 4 under MARS must open. (3)" "Squares #11; 12 must open under VENUS. (2) Square #1 must open under MERCURY. (1)" | "Draw again. (CHANCE)" |
| 24 | "POWER SQUARES Triple" "MARS is evening star of West." "FORTUNE SQUARES LOVE SQUARES Triple" "MERCURY is evening star of East." | "Squares #7, 8; 9 must open under JUPITER. (3)" "Squares #11; 12 under VENUS must open. (2) Square #1 under MERCURY must open. (1)" | "Draw again. (CHANCE)" "7C" |
| 25 | "POWER SQUARES Triple" "VENUS and MERCURY are morning stars of East." "FORTUNE SQUARES POWER SQUARES Triple" "JUPITER and MARS are morning stars of West." | "Last 5 squares under JUPITER must open. (5)" "Squares #2, 3; 4 under MERCURY must close. (3) Squares #5, 6; 7 under JUPITER must close. (3)" | none |
| 26 | "FORTUNE SQUARES Double" "VENUS is morning star of East south of Sun." "LOVE SQUARES Double" "JUPITER is morning star of West." | "Squares #5, 6, 7; 8 must open under MERCURY. (4) Squares #2, 3; 4 must close under MERCURY. (3)" "Squares #2, 3; 4 must close under VENUS. (3)" | none |
| 27 | "LOVE SQUARES Double" "VENUS is morning star of East north of Sun." "FORTUNE SQUARES Double" "JUPITER is morning star of West." | "Squares #5, 6, 7; 8 must close under VENUS. (4) Squares #2, 3; 4 must close under VENUS. (3)" "Squares #2, 3; 4 must close under MERCURY. (3)" | none |
| 28 | "FORTUNE SQUARES LOVE SQUARES Triple" "JUPITER is morning star of West." | "Squares #2, 3; 4 must open under VENUS. (3) Squares #2, 3; 4 must open under | none |

-continued

Chart No. 2

Legendary matter on individual PLANET cards

| PLANET card category | Title(s); designation (single or double); description, if any | Statement(s) | Command; composite symbol, if any |
|---|---|---|---|
| | "POWER SQUARES Triple" "MERCURY is morning star of East south of Sun." | MERCURY. (3)" "Any 2 signs of 7th or 9th HOUSE must open. (2)" | |
| 28 | "FORTUNE SQUARES LOVE SQUARES Triple" "JUPITER is morning star of West." | "Squares #2, 3; 4 under VENUS and squares #2, 3; 4 under MERCURY must open. (6)" | "Draw again. (CHANCE)" |
| | "FAME SQUARES Triple" "MERCURY is morning star of East north of Sun." | "Any 2 signs of 10th or 11th HOUSE must open. (2)" | |
| 29 | "LOVE SQUARES Double" "VENUS is evening star of West." | "Squares #8, 9; 10 must open under VENUS. (3)" | "Draw again. (CHANCE)" "3C" |
| | "FORTUNE SQUARES Double" "MERCURY is evening star of West south of Sun." | "Square #1 under MERCURY must open. (1)" | |
| 30 | "POWER SQUARES Double" "VENUS is morning star of East." | "Squares #8, 9; 10 must open under JUPITER. (3)" | "Draw again. (CHANCE)" |
| | "FAME SQUARES Double" "MERCURY is morning star of East north of Sun." | "Square #1 opens under MARS. (1)" | |
| 31 | "FORTUNE SQUARES Double" "VENUS and MERCURY are aligned evening stars of West north of Sun." | "First 3 squares under MERCURY must close. (3)" | none |
| | "LOVE SQUARES Double" "VENUS and MERCURY are aligned evening stars of West north of Sun." | "First 3 squares under VENUS must close. (3)" | |
| 32 | "POWER SQUARES Double" "JUPITER and MARS are aligned evening stars of East." | "First 3 squares under JUPITER must close. (3)" | none |
| | "FAME SQUARES Double" | "First 3 squares under MARS must close. (3)" | |
| 33 | "FORTUNE SQUARES LOVE SQUARES Triple" "MERCURY is evening star of West." | "Squares #6, 7; 8 under MERCURY must open. (3) Squares #6, 7; 8 under VENUS must open. (3)" | none |
| | "POWER SQUARES Triple" "MARS is evening star of East." | "Squares #7, 8; 9 under JUPITER must close. (3)" | |
| 34 | "FORTUNE SQUARES Single" "MERCURY is evening star of West south of Sun." | "Square #1 opens under MERCURY. (1)" | "Draw again. (CHANCE)" "8D" |
| 35 | "FORTUNE SQUARES Single" "VENUS is even- | "Square #8 opens under MERCURY. (1)" | "Draw again. (CHANCE)" |

-continued

Chart No. 2

Legendary matter on individual PLANET cards

| PLANET card category | Title(s); designation (single or double); description, if any | Statement(s) | Command; composite symbol, if any |
|---|---|---|---|
| | ing star of West south of Sun." | | "3D" |
| 35 | "FAME SQUARES Single" "MERCURY is morning star of East north of Sun." | "Square #1 opens under MARS. (1)" | "Draw again. (CHANCE)" "6C" |

What is claimed is:

1. Astrological game apparatus comprising:

a game board having thereon a plurality of segmented regions and a plurality of house areas, wherein each segmented region comprises a house area, each house area having displayed within the confines thereof legendary matter relating it to one of the zodiac signs and to at least one of the planets of the solar system;

said house areas being divided into at least four sets, each set having three house areas, the three house areas in each set having legendary matter relating each house area in the set to the same planet; the three house areas in each set being positioned in successive relationship, successive house areas displaying legendary matter relating them to the zodiac signs as they appear in the natural sequence of a solar year;

each segmented region having a plurality of subdivisions positioned proximate the periphery of one of said house areas; each of said subdivisions having displayed within the confines thereof legendary matter relating it to one of the zodiac signs;

a plurality of movable tokens for positioning in relation to the segmented regions; and means for selecting the positions of said movable tokens, the selecting means having at least two decks of cards, each card having on one face thereof legendary matter for selecting the position of a movable token relative to one of said subdivisions; only one of the decks having cards which have legendary matter related to drawing a card from the other deck.

2. Astrological game apparatus comprising:

a game board having thereon a plurality of segmented regions a plurality and of house areas, wherein each segmented region comprises a house area, each house area having displayed within the confines thereof legendary matter relating it to one of the zodiac signs and to at least one of the planets of the solar system;

said house areas being divided into at least four sets of sets, each set having three house areas, the three house areas in each set having legendary matter relating each house area in the set to the same planet; the three house areas in each set being positioned in successive relationship, successive house areas displaying legendary matter relating them to the zodiac signs as they appear in the natural sequence of a solar year;

each segmented region having a plurality of subdivisions positioned proximate the periphery of one of said house areas; each of said subdivisions having displayed within the confines thereof legendary matter relating it to one of the zodiac signs;

a plurality of movable tokens for positioning in relation to the segmented regions; and means for selecting the positions of said movable tokens, the selecting means having first means for registering a time of day in terms of its being within one of twelve approximately equal increments of a terrestrial day; second means for registering a day of the year in terms of its being within one of the twelve zodiac periods of a solar year; and a plurality of cards having on one face thereof legendary matter including a first instruction which is contingent upon the increment indicated by said first registering means and including a second instruction which is contingent upon the zodiac period indicated by said second registering means, for selecting the position of a movable token relative to said subdivisions.

3. Astrological game apparatus comprising:

a game board having thereon a plurality of house areas, each house area having displayed within the confines thereof legendary matter relating it to one of the zodiac signs; the house areas being positioned in successive relationship, successive house areas displaying legendary matter relating them to the zodiac signs as they appear in the natural sequence of a solar year; four pairs of successive house areas having displayed within the confines thereof and proximate the boundary therebetween legendary matter related to a natural phenomenon which marks a change in the seasons of the year; each of the house areas having a plurality of subdivisions positioned proximate thereto;

a plurality of movable tokens for positioning in relation to at least four sets of successive house areas; four of these sets being related to a different season of the year; and means for selecting the positions of said movable tokens, the selecting means having a first deck of cards, each card of said first deck having on one face thereof one of a plurality of composite symbols, a different composite symbol appearing on each card of said first deck; each of said subdivisions displaying within the confines thereof the same symbol as that appearing on only one of the cards of said first deck; the selecting means having second and third decks of cards, only one card of all the cards in these two decks having on one face thereof the same symbol which is displayed on one of the cards of the first deck.

4. Astrological game apparatus comprising:

a game board having thereon a plurality of house areas, each house area having displayed within the confines thereof legendary matter relating it to one of the zodiac signs; the house areas being positioned in successive relationship, successive house areas displaying legendary matter relating them to the zodiac signs as they appear in the natural sequence of a solar year; four pairs of successive house areas having displayed within the confines thereof and proximate the boundary therebetween legendary matter related to a natural phenomenon which marks a change in the seasons of the year; each of the house areas having a plurality of subdivisions positioned proximate thereto;

a plurality of movable tokens for positioning in relation to at least four sets of successive house areas; four of these sets being related to a different season of the year; and means for selecting the positions of said movable tokens, the selecting means having first, second and third decks of cards, each card of said first deck having on one face thereof one of a plurality of composite symbols, a different composite symbol appearing on each card of said first deck; each of said subdivisions displaying within the confines thereof the same symbol as that appearing on only one of the cards of said first deck; only one card of all the cards in the second and third decks having on one face thereof the same symbol which is displayed on one of the cards of the first deck; only cards within the second and third decks having legendary matter displayed on one face thereof related to drawing a card from the first deck and only cards within the second deck having legendary matter displayed on one face thereof related to drawing another card from the second deck.

* * * * *